US012806473B2

(12) United States Patent
Kim et al.

(10) Patent No.: US 12,806,473 B2
(45) Date of Patent: Nov. 24, 2026

(54) WEARABLE ELECTRONIC DEVICE FOR OUTPUTTING INFORMATION ON EXERCISE, AND CONTROL METHOD OF WEARABLE ELECTRONIC DEVICE

(71) Applicant: Samsung Electronics Co., Ltd., Suwon-si (KR)

(72) Inventors: Hyeonseong Kim, Suwon-si (KR); Jeongmin Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 420 days.

(21) Appl. No.: 18/486,377

(22) Filed: Oct. 13, 2023

(65) Prior Publication Data

US 2024/0033575 A1 Feb. 1, 2024

Related U.S. Application Data

(63) Continuation of application No. PCT/KR2022/003696, filed on Mar. 16, 2022.

(30) Foreign Application Priority Data

Apr. 13, 2021 (KR) ..... 10-2021-0047906

(51) Int. Cl.
*A63B 24/00* (2006.01)
*A63B 5/20* (2006.01)
*A63B 71/06* (2006.01)

(52) U.S. Cl.
CPC ..... *A63B 24/0062* (2013.01); *A63B 5/20* (2013.01); *A63B 24/0075* (2013.01); (Continued)

(58) Field of Classification Search
CPC ... A63B 24/0062; A63B 5/20; A63B 24/0075; A63B 2071/0663; A63B 2220/62; A63B 2220/836; A63B 71/0619; A63B 2244/08
See application file for complete search history.

(56) References Cited

U.S. PATENT DOCUMENTS 8,487,746 B2 * 7/2013 Gordon ..... A63B 71/0686 482/82
2008/0090703 A1 4/2008 Rosenberg
(Continued)

FOREIGN PATENT DOCUMENTS

JP 2008029475 A 2/2008
JP 2018506763 A 3/2018
(Continued)

OTHER PUBLICATIONS

Korean Office Action dated Nov. 12, 2025 for KR Application No. 10-2021-0047906.
(Continued)

*Primary Examiner* — Ricky Go
(74) *Attorney, Agent, or Firm* — Nixon & Vanderhye P.C.

(57) ABSTRACT

A wearable electronic device may include an acceleration sensor and at least one processor, wherein the at least one processor may be configured to obtain acceleration data through the acceleration sensor, identify that a user of the wearable electronic device is performing a jump rope exercise on the basis of at least a part of the acceleration data, identify at least one of a flight time or a ground contact time on the basis of the acceleration data, and output guide information on the jump rope exercise on the basis of at least one of the flight time or the ground contact time. Various other embodiments are possible.

20 Claims, 23 Drawing Sheets

(52) U.S. Cl.
CPC ... *A63B 2071/0663* (2013.01); *A63B 2220/40* (2013.01); *A63B 2220/62* (2013.01); *A63B 2220/836* (2013.01)

(56) References Cited

U.S. PATENT DOCUMENTS

| | | | | |
|---|---|---|---|---|
| 2011/0169725 | A1 | 7/2011 | Ueshima et al. | |
| 2016/0059073 | A1* | 3/2016 | Jeon | G06Q 30/0241 482/8 |
| 2016/0081625 | A1* | 3/2016 | Kim | H04W 4/70 600/595 |
| 2017/0043217 | A1* | 2/2017 | Lee | G06V 40/23 |
| 2017/0046503 | A1 | 2/2017 | Cho et al. | |
| 2017/0337349 | A1 | 11/2017 | Cronin | |
| 2018/0169474 | A1* | 6/2018 | Reddy | G09B 5/06 |

FOREIGN PATENT DOCUMENTS

| | | | |
|---|---|---|---|
| KR | 20070036393 | A | 4/2007 |
| KR | 20110127856 | A | 11/2011 |
| KR | 101487391 | B1 | 1/2015 |
| KR | 101557237 | B1 | 10/2015 |
| KR | 20170019196 | A | 2/2017 |
| KR | 20190023611 | A | 3/2019 |

OTHER PUBLICATIONS

International Search Report for PCT/KR2022/003696 mailed Jun. 22, 2022, 7 pages.
Written Opinion of the ISA for PCT/KR2022/003696 mailed Jun. 22, 2022, 5 pages.

* cited by examiner

WEARABLE ELECTRONIC DEVICE FOR OUTPUTTING INFORMATION ON EXERCISE, AND CONTROL METHOD OF WEARABLE ELECTRONIC DEVICE

CROSS REFERENCE TO RELATED APPLICATIONS

This application is a continuation of International Application No. PCT/KR2022/003696 filed on Mar. 16, 2022, designating the United States, in the Korean Intellectual Property Receiving Office, and claiming priority to Korean Patent Application No. 10-2021-0047906 filed on Apr. 13, 2021, the disclosures of which are all hereby incorporated by reference herein in their entireties.

BACKGROUND

Field

Various example embodiments relate to a wearable electronic device that outputs exercise-related information and/or a method for controlling the wearable electronic device.

Description of Related Art

As interest in personal health increases, wearable electronic devices that output information about exercise are widely used. For example, when the user is exercising with a wearable electronic device worn, the wearable electronic device may output information, such as calories consumed during exercise, the user's heart rate, and/or the required exercise time. The user may obtain feedback on exercise and adjust his or her exercise habit by identifying exercise-related information through the wearable electronic device.

SUMMARY

A wearable electronic device that outputs information about a jump rope exercise may determine whether the user is jumping rope, and provide the number of jump ropes to the user when it is identified that the user is jumping rope.

However, since conventional wearable electronic devices simply provide the user with the number of jump ropes and do not provide information for correcting the user's rope jumping habit, it may be difficult for the user to correct the rope jumping habit.

A wearable electronic device according to an example embodiment may identify at least one of a time of staying in the air or a time of contacting a ground and output guide information about a jump rope exercise based on at least one of the time of staying in the air or the time of contacting the ground.

A wearable electronic device according to an example embodiment may comprise an acceleration sensor and at least one processor. The at least one processor may be configured to obtain acceleration data through the acceleration sensor, identify that a user of the wearable electronic device is doing a jump rope exercise based on at least a portion of the acceleration data, identify at least one of a time of staying in the air or a time of contacting a ground based on the acceleration data, and output guide information about the jump rope exercise based on at least one of the time of staying in the air or time of contacting the ground.

A method performed in a wearable electronic device according to an example embodiment may comprise obtaining acceleration data, identifying that a user of the wearable electronic device is doing a jump rope exercise based on at least a portion of the acceleration data, identifying least one of a time of staying in the air or a time of contacting a ground based on the acceleration data, and outputting guide information about the jump rope exercise based on at least one of the time of staying in the air or the time of contacting the ground.

According to an example embodiment, there may be provided a wearable electronic device for outputting information regarding exercise and/or a method for controlling a wearable electronic device. A wearable electronic device according to an example embodiment may identify at least one of a time of staying in the air or a time of contacting a ground and output guide information about a jump rope exercise based on at least one of the time of staying in the air or the time of contacting the ground. Accordingly, the user may change the environment where the jump rope exercise occurs or correct the exercise habit based on the guide information.

BRIEF DESCRIPTION OF DRAWINGS

The foregoing and other features of example embodiments will become more apparent from the following detailed description of embodiments when read in conjunction with the accompanying drawings. In the drawings, like reference numerals refer to like elements.

DETAILED DESCRIPTION

Figure 1:
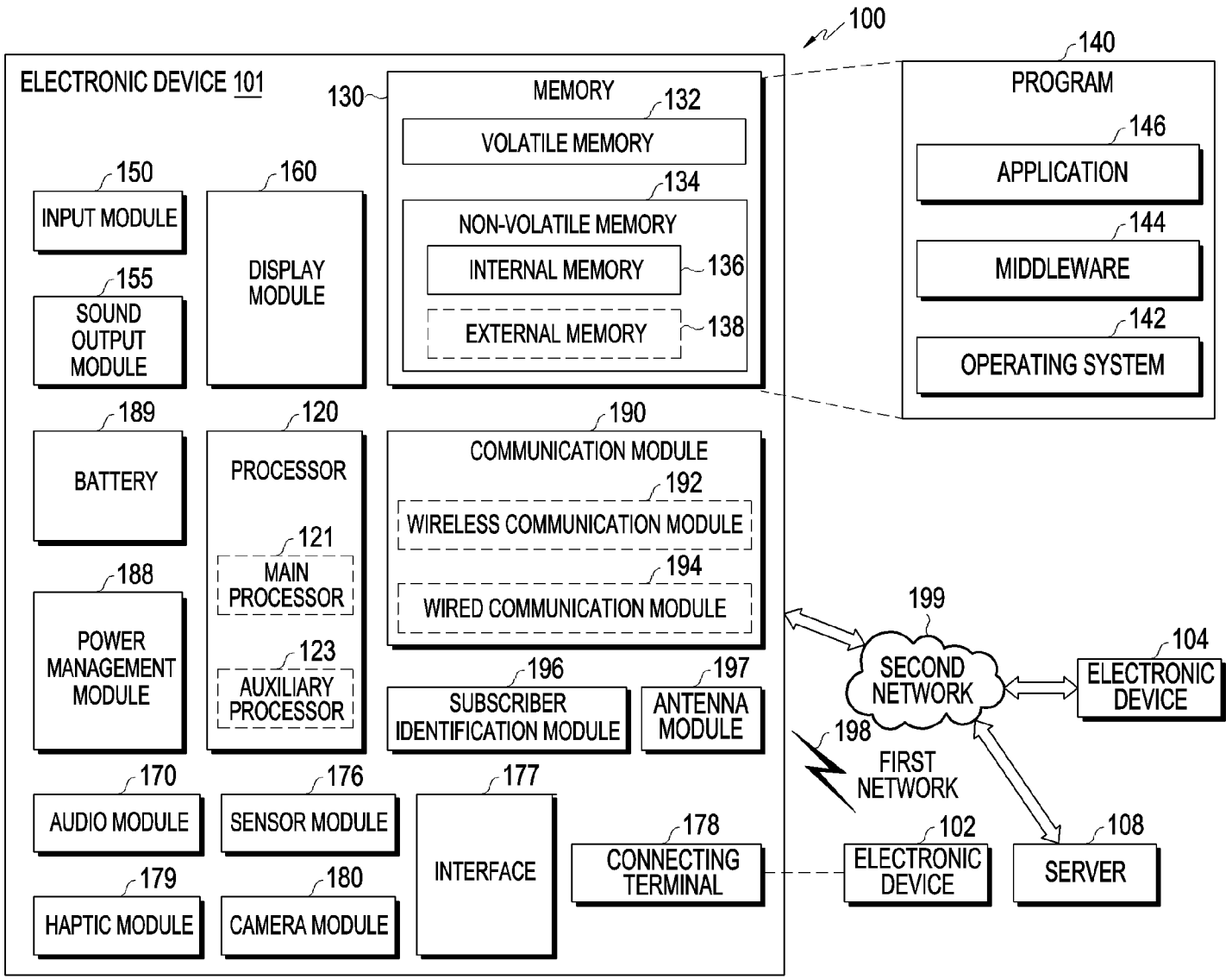
FIG. 1 is a view illustrating an electronic device in a network environment according to various example embodiments.

FIG. 1 is a block diagram illustrating an electronic device 101 in a network environment 100 according to various embodiments. Referring to FIG. 1, the electronic device 101 in the network environment 100 may communicate with an electronic device 102 via a first network 198 (e.g., a short-range wireless communication network), or an electronic device 104 or a server 108 via a second network 199 (e.g., a long-range wireless communication network). According to an embodiment, the electronic device 101 may communicate with the electronic device 104 via the server 108. According to an embodiment, the electronic device 101 may include a processor 120, memory 130, an input module 150, a sound output module 155, a display module 160, an audio module 170, a sensor module 176, an interface 177, a connecting terminal According to an embodiment, the display module 160 may include a first display module 351 corresponding to the user's left eye and/or a second display module 353 corresponding to the user's right eye., a haptic module 179, a camera module 180, a power management module 188, a battery 189, a communication module 190, a subscriber identification module (SIM) 196, or an antenna module 197. In an embodiment, at least one (e.g., the connecting terminal 178) of the components may be omitted from the electronic device 101, or one or more other components may be added in the electronic device 101. According to an embodiment, some (e.g., the sensor module 176, the camera module 180, or the antenna module 197) of the components may be integrated into a single component (e.g., the display module 160).

The processor 120 may execute, for example, software (e.g., a program 140) to control at least one other component (e.g., a hardware or software component) of the electronic device 101 coupled with the processor 120, and may perform various data processing or computation. According to an embodiment, as at least part of the data processing or computation, the processor 120 may store a command or data received from another component (e.g., the sensor module 176 or the communication module 190) in volatile memory 132, process the command or the data stored in the volatile memory 132, and store resulting data in non-volatile memory 134. According to an embodiment, the processor 120 may include a main processor 121 (e.g., a central processing unit (CPU) or an application processor (AP)), or an auxiliary processor 123 (e.g., a graphics processing unit (GPU), a neural processing unit (NPU), an image signal processor (ISP), a sensor hub processor, or a communication processor (CP)) that is operable independently from, or in conjunction with, the main processor 121. For example, when the electronic device 101 includes the main processor 121 and the auxiliary processor 123, the auxiliary processor 123 may be configured to use lower power than the main processor 121 or to be specified for a designated function. The auxiliary processor 123 may be implemented as separate from, or as part of the main processor 121.

The auxiliary processor 123 may control at least some of functions or states related to at least one component (e.g., the display module 160, the sensor module 176, or the communication module 190) among the components of the electronic device 101, instead of the main processor 121 while the main processor 121 is in an inactive (e.g., sleep) state, or together with the main processor 121 while the main processor 121 is in an active state (e.g., executing an application). According to an embodiment, the auxiliary processor 123 (e.g., an image signal processor or a communication processor) may be implemented as part of another component (e.g., the camera module 180 or the communication module 190) functionally related to the auxiliary processor 123. According to an embodiment, the auxiliary processor 123 (e.g., the neural processing unit) may include a hardware structure specified for artificial intelligence model processing. The artificial intelligence model may be generated via machine learning. Such learning may be performed, e.g., by the electronic device 101 where the artificial intelligence is performed or via a separate server (e.g., the server 108). Learning algorithms may include, but are not limited to, e.g., supervised learning, unsupervised learning, semi-supervised learning, or reinforcement learning. The artificial intelligence model may include a plurality of artificial neural network layers. The artificial neural network may be a deep neural network (DNN), a convolutional neural network (CNN), a recurrent neural network (RNN), a restricted Boltzmann machine (RBM), a deep belief network (DBN), a bidirectional recurrent deep neural network (BRDNN), deep Q-network or a combination of two or more thereof but is not limited thereto. The artificial intelligence model may, additionally or alternatively, include a software structure other than the hardware structure.

The memory 130 may store various data used by at least one component (e.g., the processor 120 or the sensor module 176) of the electronic device 101. The various data may include, for example, software (e.g., the program 140) and input data or output data for a command related thereto. The memory 130 may include the volatile memory 132 or the non-volatile memory 134.

The program 140 may be stored in the memory 130 as software, and may include, for example, an operating system (OS) 142, middleware 144, or an application 146.

The input module 150 may receive a command or data to be used by other component (e.g., the processor 120) of the electronic device 101, from the outside (e.g., a user) of the electronic device 101. The input module 150 may include, for example, a microphone, a mouse, a keyboard, keys (e.g., buttons), or a digital pen (e.g., a stylus pen).

The sound output module 155 may output sound signals to the outside of the electronic device 101. The sound output module 155 may include, for example, a speaker or a receiver. The speaker may be used for general purposes, such as playing multimedia or playing record. The receiver may be used for receiving incoming calls. According to an embodiment, the receiver may be implemented as separate from, or as part of the speaker.

The display module 160 may visually provide information to the outside (e.g., a user) of the electronic device 101. The display 160 may include, for example, a display, a hologram device, or a projector and control circuitry to control a corresponding one of the display, hologram device, and projector. According to an embodiment, the display 160 may include a touch sensor configured to detect a touch, or a pressure sensor configured to measure the intensity of a force generated by the touch.

The audio module 170 may convert a sound into an electrical signal and vice versa. According to an embodiment, the audio module 170 may obtain the sound via the input module 150, or output the sound via the sound output module 155 or a headphone of an external electronic device (e.g., an electronic device 102) directly (e.g., wiredly) or wirelessly coupled with the electronic device 101.

The sensor module 176 may detect an operational state (e.g., power or temperature) of the electronic device 101 or an environmental state (e.g., a state of a user) external to the electronic device 101, and then generate an electrical signal or data value corresponding to the detected state. According to an embodiment, the sensor module 176 may include, for example, a gesture sensor, a gyro sensor, an atmospheric pressure sensor, a magnetic sensor, an accelerometer, a grip sensor, a proximity sensor, a color sensor, an infrared (IR) sensor, a biometric sensor, a temperature sensor, a humidity sensor, or an illuminance sensor.

The interface 177 may support one or more specified protocols to be used for the electronic device 101 to be coupled with the external electronic device (e.g., the electronic device 102) directly (e.g., wiredly) or wirelessly. According to an embodiment, the interface 177 may include, for example, a high definition multimedia interface (HDMI), a universal serial bus (USB) interface, a secure digital (SD) card interface, or an audio interface.

A connecting terminal 178 may include a connector via which the electronic device 101 may be physically connected with the external electronic device (e.g., the electronic device 102). According to an embodiment, the connecting terminal 178 may include, for example, a HDMI connector, a USB connector, a SD card connector, or an audio connector (e.g., a headphone connector).

The haptic module 179 may convert an electrical signal into a mechanical stimulus (e.g., a vibration or motion) or electrical stimulus which may be recognized by a user via his tactile sensation or kinesthetic sensation. According to an embodiment, the haptic module 179 may include, for example, a motor, a piezoelectric element, or an electric stimulator.

The camera module 180 may capture a still image or moving images. According to an embodiment, the camera module 180 may include one or more lenses, image sensors, image signal processors, or flashes.

The power management module 188 may manage power supplied to the electronic device 101. According to an embodiment, the power management module 188 may be implemented as at least part of, for example, a power management integrated circuit (PMIC).

The battery 189 may supply power to at least one component of the electronic device 101. According to an embodiment, the battery 189 may include, for example, a primary cell which is not rechargeable, a secondary cell which is rechargeable, or a fuel cell.

The communication module 190 may support establishing a direct (e.g., wired) communication channel or a wireless communication channel between the electronic device 101 and the external electronic device (e.g., the electronic device 102, the electronic device 104, or the server 108) and performing communication via the established communication channel. The communication module 190 may include one or more communication processors that are operable independently from the processor 120 (e.g., the application processor (AP)) and supports a direct (e.g., wired) communication or a wireless communication. According to an embodiment, the communication module 190 may include a wireless communication module 192 (e.g., a cellular communication module, a short-range wireless communication module, or a global navigation satellite system (GNSS) communication module) or a wired communication module 194 (e.g., a local area network (LAN) communication module or a power line communication (PLC) module). A corresponding one of these communication modules may communicate with the external electronic device 104 via a first network 198 (e.g., a short-range communication network, such as Bluetooth™, wireless-fidelity (Wi-Fi) direct, or infrared data association (IrDA)) or a second network 199 (e.g., a long-range communication network, such as a legacy cellular network, a 5G network, a next-generation communication network, the Internet, or a computer network (e.g., local area network (LAN) or wide area network (WAN)). These various types of communication modules may be implemented as a single component (e.g., a single chip), or may be implemented as multi components (e.g., multi chips) separate from each other. The wireless communication module 192 may identify or authenticate the electronic device 101 in a communication network, such as the first network 198 or the second network 199, using subscriber information (e.g., international mobile subscriber identity (IMSI)) stored in the subscriber identification module 196.

The wireless communication module 192 may support a 5G network, after a 4G network, and next-generation communication technology, e.g., new radio (NR) access technology. The NR access technology may support enhanced mobile broadband (eMBB), massive machine type communications (mMTC), or ultra-reliable and low-latency communications (URLLC). The wireless communication module 192 may support a high-frequency band (e.g., the mmWave band) to achieve, e.g., a high data transmission rate. The wireless communication module 192 may support various technologies for securing performance on a high-frequency band, such as, e.g., beamforming, massive multiple-input and multiple-output (massive MIMO), full dimensional MIMO (FD-MIMO), array antenna, analog beam-forming, or large scale antenna. The wireless communication module 192 may support various requirements specified in the electronic device 101, an external electronic device (e.g., the electronic device 104), or a network system (e.g., the second network 199). According to an embodiment, the wireless communication module 192 may support a peak data rate (e.g., 20 Gbps or more) for implementing eMBB, loss coverage (e.g., 164 dB or less) for implementing mMTC, or U-plane latency (e.g., 0.5 ms or less for each of downlink (DL) and uplink (UL), or a round trip of 1 ms or less) for implementing URLLC.

The antenna module 197 may transmit or receive a signal or power to or from the outside (e.g., the external electronic device). According to an embodiment, the antenna module 197 may include one antenna including a radiator formed of a conductive body or conductive pattern formed on a substrate (e.g., a printed circuit board (PCB)). According to an embodiment, the antenna module 197 may include a plurality of antennas (e.g., an antenna array). In this case, at least one antenna appropriate for a communication scheme used in a communication network, such as the first network 198 or the second network 199, may be selected from the plurality of antennas by, e.g., the communication module 190. The signal or the power may then be transmitted or received between the communication module 190 and the external electronic device via the selected at least one antenna. According to an embodiment, other parts (e.g., radio frequency integrated circuit (RFIC)) than the radiator may be further formed as part of the antenna module 197.

According to various embodiments, the antenna module 197 may form a mmWave antenna module. According to an embodiment, the mmWave antenna module may include a printed circuit board, a RFIC disposed on a first surface (e.g., the bottom surface) of the printed circuit board, or adjacent to the first surface and capable of supporting a designated high-frequency band (e.g., the mmWave band), and a plurality of antennas (e.g., array antennas) disposed on a second surface (e.g., the top or a side surface) of the printed circuit board, or adjacent to the second surface and capable of transmitting or receiving signals of the designated high-frequency band.

At least some of the above-described components may be coupled mutually and communicate signals (e.g., commands or data) therebetween via an inter-peripheral communication scheme (e.g., a bus, general purpose input and output (GPIO), serial peripheral interface (SPI), or mobile industry processor interface (MIPI)).

According to an embodiment, commands or data may be transmitted or received between the electronic device 101 and the external electronic device 104 via the server 108 coupled with the second network 199. The external electronic devices 102 or 104 each may be a device of the same or a different type from the electronic device 101. According to an embodiment, all or some of operations to be executed at the electronic device 101 may be executed at one or more of the external electronic devices 102, 104, or 108. For example, if the electronic device 101 should perform a function or a service automatically, or in response to a request from a user or another device, the electronic device 101, instead of, or in addition to, executing the function or the service, may request the one or more external electronic devices to perform at least part of the function or the service. The one or more external electronic devices receiving the request may perform the at least part of the function or the service requested, or an additional function or an additional service related to the request, and transfer an outcome of the performing to the electronic device 101. The electronic device 101 may provide the outcome, with or without further processing of the outcome, as at least part of a reply to the request. To that end, a cloud computing, distributed computing, mobile edge computing (MEC), or client-server computing technology may be used, for example. The electronic device 101 may provide ultra low-latency services using, e.g., distributed computing or mobile edge computing. In another embodiment, the external electronic device 104 may include an Internet-of-things (IoT) device. The server 108 may be an intelligent server using machine learning and/or a neural network. According to an embodiment, the external electronic device 104 or the server 108 may be included in the second network 199. The electronic device 101 may be applied to intelligent services (e.g., smart home, smart city, smart car, or health-care) based on 5G communication technology or IoT-related technology.

The electronic device according to various embodiments of the disclosure may be one of various types of electronic devices. The electronic devices may include, for example, a portable communication device (e.g., a smartphone), a computer device, a portable multimedia device, a portable medical device, a camera, a wearable device, or a home appliance. According to an embodiment of the disclosure, the electronic devices are not limited to those described above.

Figure 2:
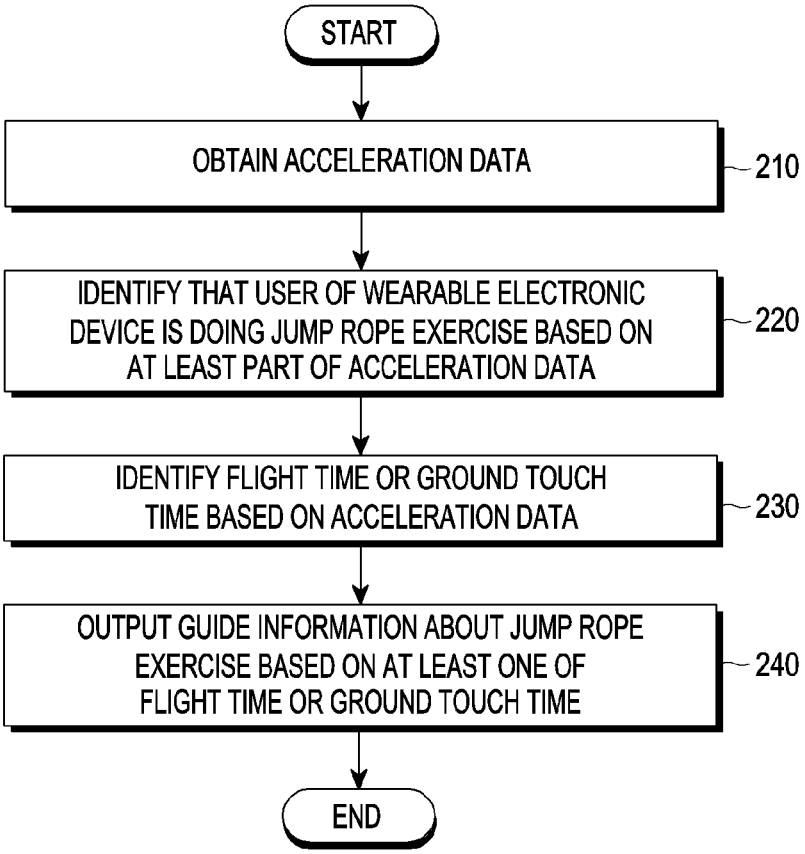
FIG. 2 is a flowchart illustrating operations performed in a wearable electronic device according to an embodiment.

FIG. 2 is a flowchart illustrating operations performed in a wearable electronic device according to an embodiment.

In operation 210, at least one processor (e.g., the processor 120) of the wearable electronic device (e.g., the electronic device 101) may obtain acceleration data through the acceleration sensor.

In operation 220, the at least one processor (e.g., the processor 120) of the wearable electronic device (e.g., the electronic device 101) may identify that the user of the wearable electronic device 101 is doing a jump rope exercise, based at least in part on acceleration data.

According to an embodiment, the at least one processor 120 may identify that the user of the wearable electronic device 101 is doing a jump rope exercise using acceleration data without using gyro data. Exemplary operations performed to identify that the user of the wearable electronic device 101 is doing a jump rope exercise using the acceleration data is described below with reference to FIG. 3. According to an embodiment, the at least one processor 120 may identify that the user is doing a jump rope exercise based on acceleration data corresponding to the axis having a dominant data size among the x-axis acceleration data, the y-axis acceleration data, and the z-axis acceleration data constituting the acceleration data. For example, when the y-axis is the dominant axis, if it is identified that the zero crossing (ZC) point of the y-axis acceleration data is repeated at a predetermined time interval, the at least one processor 120 may identify that the user is doing a jump rope exercise. The ZC point of the y-axis acceleration data may refer to a point at which the y-direction component of the y-axis acceleration becomes 0 while the y-direction component of the acceleration changes from positive to negative. According to an embodiment, the at least one processor 120 may identify that the user is doing a jump rope exercise based on acceleration data reproduced by synthesis of a plurality of axes.

According to an embodiment, the at least one processor 120 may identify that the user of the wearable electronic device 101 is doing a jump rope exercise by additionally using gyro data as well as acceleration data. According to an embodiment, the at least one processor 120 may identify that the user is doing a jump rope exercise based on the acceleration data corresponding to the axis where the data size is dominant among the x-axis acceleration data, the y-axis acceleration data, and the z-axis acceleration data constituting the acceleration data, the acceleration data reproduced by synthesis of the plurality of axes, the gyro data corresponding to the axis where the data size is dominant among the x-axis gyro data, the y-axis gyro data, and the z-axis gyro data constituting the gyro data, or the gyro data reproduced by synthesis of the plurality of axes.

According to an embodiment, the at least one processor 120 may identify the magnitude of the acceleration based on the acceleration data, identify the magnitude of the angular acceleration based on the gyro data, and if it is identified that the ZC point of the acceleration magnitude and the ZC point of the angular acceleration magnitude are repeated at predetermined time intervals, identify that the user is doing a jump rope exercise. The ZC point of the acceleration magnitude or the ZC point of the angular acceleration magnitude may refer to a point at which the acceleration magnitude or the angular acceleration magnitude becomes 0 while the acceleration magnitude or the angular acceleration magnitude changes from positive to negative. The acceleration magnitude $a_{NORM}$ may be defined as in Equation 1.

$$a_{NORM} = \sqrt{(a_x^2 + a_y^2 + a_z^2)} \quad \text{[Equation 1]}$$

In Equation 1, $a_x$, $a_y$, and $a_z$, respectively, are the magnitudes of the three-axis accelerations.

The angular acceleration magnitude $\omega_{NORM}$ may be defined as in Equation 2.

$$\omega_{NORM} = \sqrt{(\omega_x^2 + \omega_y^2 + \omega_z^2)} \quad \text{[Equation 2]}$$

In Equation 2, $\omega_x$, $\omega_y$, and $\omega_z$, respectively, are the magnitudes of the three-axis accelerations.

According to an embodiment, the at least one processor (e.g., the processor 120) of the wearable electronic device (e.g., the electronic device 101) may identify that the user of the wearable electronic device 101 is doing a jump rope exercise using the machine learning engine 1650*a* and the exercise detection engine 1630*a*, which are described below with reference to FIG. 16A.

In operation 230, the at least one processor (e.g., the processor 120) of the wearable electronic device (e.g., the electronic device 101) may identify at least one of the time of staying in the air or the time of contacting the ground based on the acceleration data.

Figure 6:
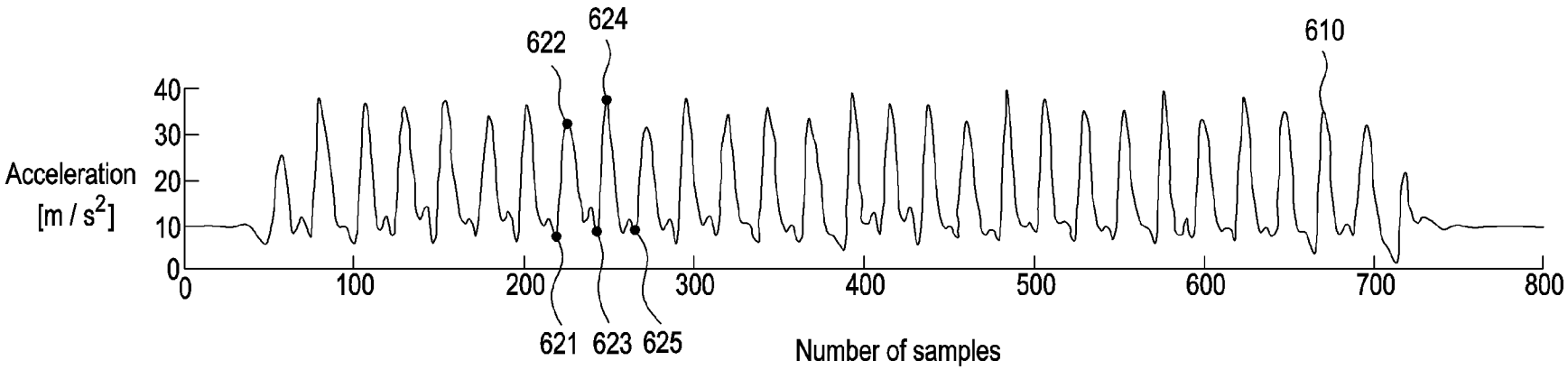
FIG. 6 illustrates an example of a curve indicating the magnitude of acceleration when a user does the alternate foot jump.

According to an embodiment, the at least one processor 120 may identify the magnitude of the acceleration based on the acceleration data. FIG. 6 illustrates an example of a curve indicating the magnitude of acceleration. Referring to FIG. 6, a curve 610 indicates the magnitude of acceleration when the user does an alternate foot jump. The curve 610 has a periodic shape, and the lowest points 621, 623, and 625 and the highest points 622 and 624 may be defined within each period. Within each period of the curve 610, the section from the lowest point 621 to the highest point 622 may correspond to a section in which the foot does not touch the ground, and the section from the highest point 622 to the next lowest point 623 may correspond to a ground touch section in which the foot touches the ground. According to an embodiment, the at least one processor 120 may identify the time corresponding to the section from the lowest point 621 or 623 to the highest point 622 or 624 of the curve 610 as the time of staying in the air. According to an embodiment, the at least one processor 120 may identify the times corresponding to the section from the highest point 622 or 624 to the next lowest point 623 or 625 of the curve 610 as the time of contacting the ground.

According to an embodiment, when at least one of the time of staying in the air or the time of contacting the ground is identified for two or more periods, two or more times of staying in the air or times of contacting the ground may be identified, and the value representing the two or more times of staying in the air or times of contacting the ground may be identified as the final jump frequency. For example, an average value, a maximum value, or a minimum value of two or more times of staying in the air or times of contacting the ground may be identified as a final time of staying in the air or a final time of contacting the ground.

Although not illustrated in FIG. 2, according to an embodiment, the at least one processor 120 may identify various pieces of information other than the time of staying in the air or the time of contacting the ground based on the acceleration data. According to an embodiment, the at least one processor 120 may identify the difference between the time when it is identified that the user of the wearable electronic device 101 is doing the jump rope exercise and the current time as the time required for the jump rope exercise. According to an embodiment, the at least one processor 120 may identify a sliding window summing (SWS) difference value of acceleration, and identify the number of ZC points of the SWS difference value as the number of jump ropes. The SWS value corresponding to the window having the size N may be defined as in Equation 3.

$$SWS(k) = \sum_{i=k-N+1}^{k} a_{NORM}(i) \quad \text{[Equation 3]}$$

The SWS difference value may be defined as in Equation 4.

$$SWS_{diff}(k) = SWS(k-N+1) - SWS(k) \quad \text{[Equation 4]}$$

The ZC point of the SWS difference value may refer to a point at which the SWS difference value becomes 0 while the SWS difference value changes from positive to negative.

According to an embodiment, the at least one processor 120 may identify the number of jump ropes per minute (cadence) based on the number of jump ropes. According to an embodiment, the at least one processor 120 may identify the jump frequency based on the difference in time corresponding to the adjacent ZC of the SWS difference value. The jump frequency F may be defined as in Equation 5.

$$F = \frac{1}{t_i - t_{i-1}} \quad \text{[Equation 5]}$$

In Equation 5, $t_i$ is the time at the ith ZC point, and $t_{i-1}$ is the time at the i-1 th ZC point. When there are three or more ZC points, two or more jump frequencies F may be identified, and a value representing the two or more jump frequencies F may be identified as a final jump frequency. For example, an average value, a maximum value, or a minimum value of the two or more F values may be identified as the final jump frequency.

According to an embodiment, the at least one processor 120 may identify the maximum value of the acceleration magnitude within one period as the maximum impact amount in the periodically repeated acceleration magnitude. According to an embodiment, the at least one processor 120 may identify the left/right balance based on the ratio between the odd-numbered time of contacting the ground and the even-numbered time of contacting the ground. The user may refer to the left/right balance when an action corresponding to the left and an action corresponding to the right alternately occur, such as the alternate foot jump. For example, the at least one processor 120 may identify the ratio between the odd-numbered ground time and the even-numbered ground time as the left/right balance, or determine that the left/right balance is better as the ratio between the odd-numbered ground time and the even-numbered ground time is closer to 1. According to an embodiment, the at least one processor 120 may identify the isokineticity indicating how constant the user's jumping frequency is based on the variance of the jump frequency.

In operation 240, the at least one processor (e.g., the processor 120) of the wearable electronic device (e.g., the electronic device 101) may output guide information about the jump rope exercise, based on at least one of the time of staying in the air or the time of contacting the ground.

According to an embodiment, the at least one processor 120 may output guide information by controlling a display (e.g., the display module 160 comprising a display) to visually display the guide information. According to an embodiment, the at least one processor 120 may output guide information by controlling a sound output module (e.g., the sound output module 155) to output a voice corresponding to the guide information. According to an embodiment, the at least one processor 120 may output the guide information by controlling the communication module 190, comprising communication circuitry, to transmit the guide information to another electronic device 104 such that the guide information is output through the other electronic device (e.g., the electronic device 104).

Figure 7A:
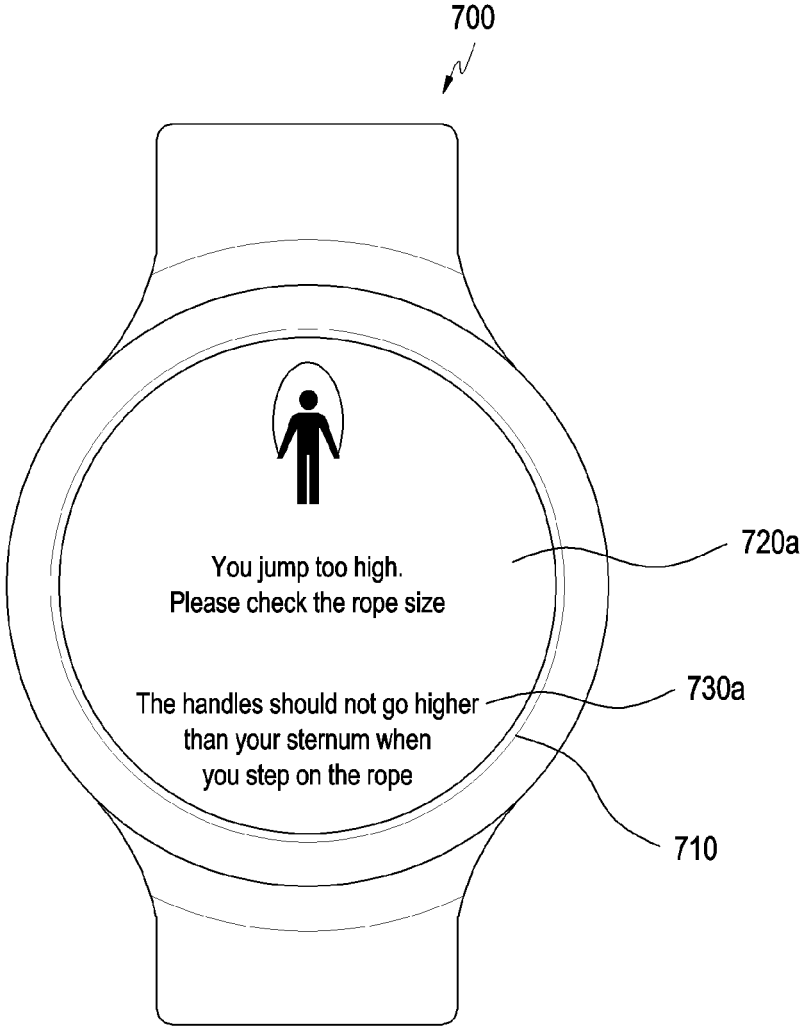
FIG. 7A illustrates a wearable electronic device outputting example guide information according to an embodiment.

According to an embodiment, when the at least one processor 120 identifies the time of staying in the air in operation 230, the at least one processor 120 may output first guide information in response to the identified time of staying in the air exceeding a first threshold. The time of staying in the air is longer than the first threshold may indicate that the jump height is too high. FIG. 7A illustrates a wearable electronic device displaying first guide information according to an embodiment. Referring to FIG. 7A, the wearable electronic device 700 may display first guide information on the display 710. According to an embodiment, the first guide information may include a message 720*a* suggesting to check the length of the jump rope because the jump is too high. According to an embodiment, the first guide information may include a message 730*a* for guiding a method of setting a preferred length of the jump rope.

Figure 7B:
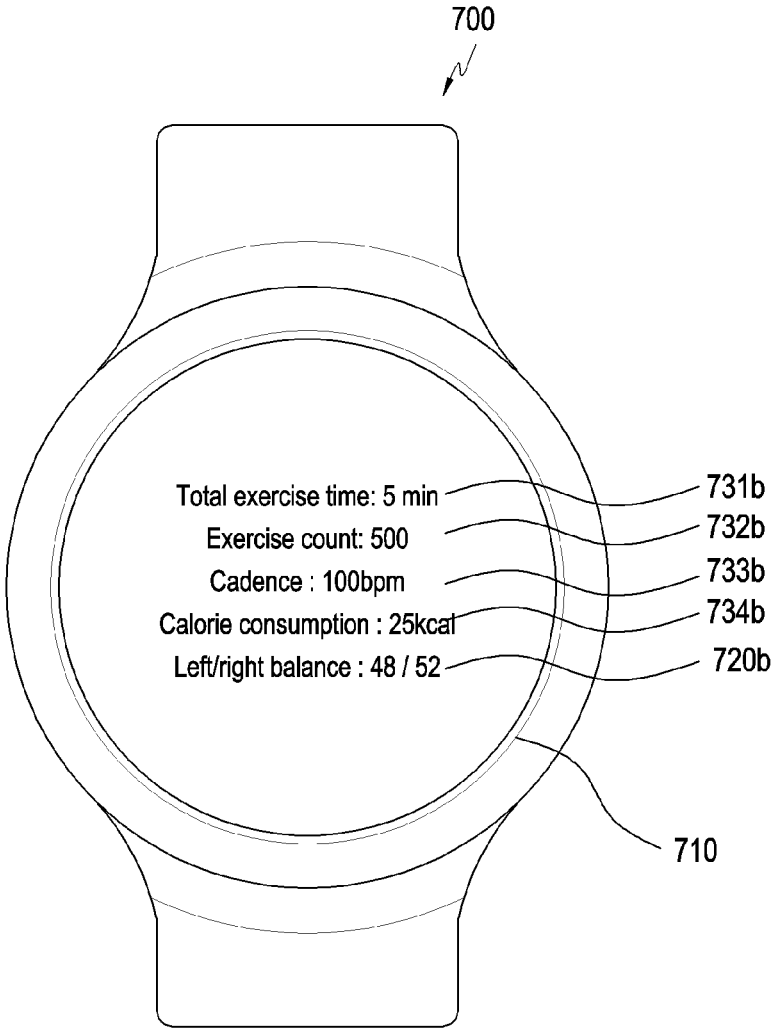
FIG. 7B illustrates a wearable electronic device outputting example guide information according to an embodiment.

According to an embodiment, when the at least one processor 120 identifies the time of contacting the ground in operation 230, the at least one processor 120 may output second guide information indicating the time of contacting the ground. FIG. 7B illustrates a wearable electronic device displaying second guide information according to an embodiment. Referring to FIG. 7B, the wearable electronic device 700 may display second guide information on the display 710. According to an embodiment, the second guide information may include a left/right balance 720*b* based on a ratio between an even-numbered ground time and an odd-numbered ground time. According to an embodiment, the second guide information may further include the required time 731*b* of the jump rope exercise, the number of jump ropes 732*b*, the number of jump ropes per minute (cadence) 733*b*, and the calorie consumption 734*b*. According to an embodiment, the second guide information may further include at least one of a maximum impact amount and an isokineticity.

According to an embodiment, the at least one processor (e.g., the processor 120) of the wearable electronic device (e.g., the electronic device 101) may output various pieces of information as part of the guide information displayed in operation 240. For example, the at least one processor 120 may output at least one of the required time, the number of jump ropes, the number of jump ropes per minute, the jump frequency, the maximum impact amount, the left/right balance, or the isokineticity of the jump rope exercise as part of the first guide information or the second guide information.

According to an embodiment, the at least one processor (e.g., the processor 120) of the wearable electronic device (e.g., the electronic device 101) may output various pieces of information separately from the guide information displayed in operation 240. For example, the at least one processor 120 may display at least one of the required time, the number of jump ropes, the number of jump ropes per minute, the jump frequency, the maximum impact amount, the left/right balance, or the isokineticity of the jump rope exercise on a screen separate from the screen on which the first guide information or the second guide information is displayed.

Figure 3:
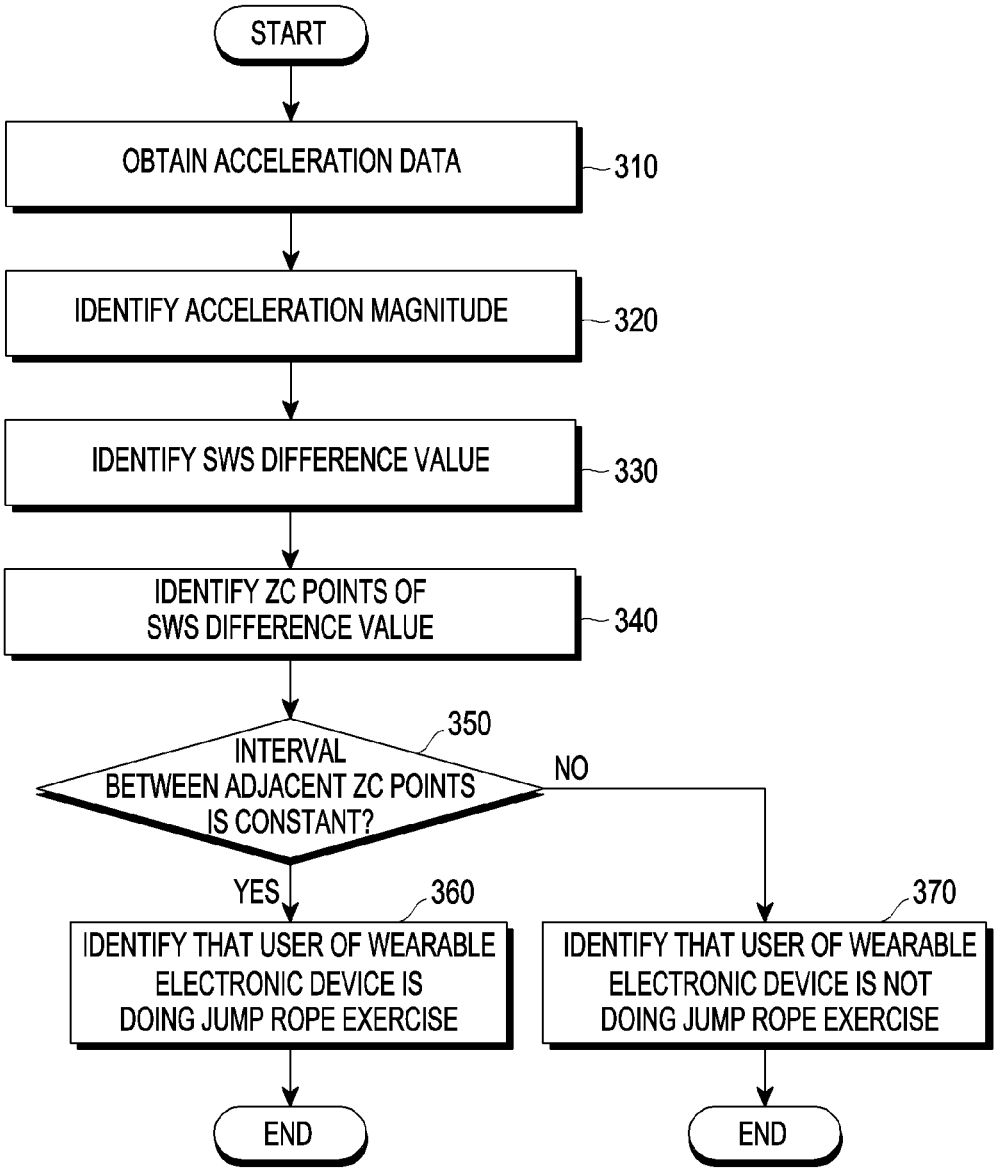
FIG. 3 is a flowchart illustrating operations performed to identify whether a user is doing a jump rope exercise by a wearable electronic device according to an embodiment.

FIG. 3 is a flowchart illustrating operations performed to identify whether a user is doing a jump rope exercise by a wearable electronic device according to an embodiment.

In operation 310, at least one processor (e.g., the processor 120) of the wearable electronic device (e.g., the electronic device 101) may obtain acceleration data. According to an embodiment, the acceleration data may include x-axis acceleration data indicating an x-direction component of an acceleration, y-axis acceleration data indicating a y-direction component of the acceleration, and z-axis acceleration data indicating a z-direction component of the acceleration.

Figure 4A:
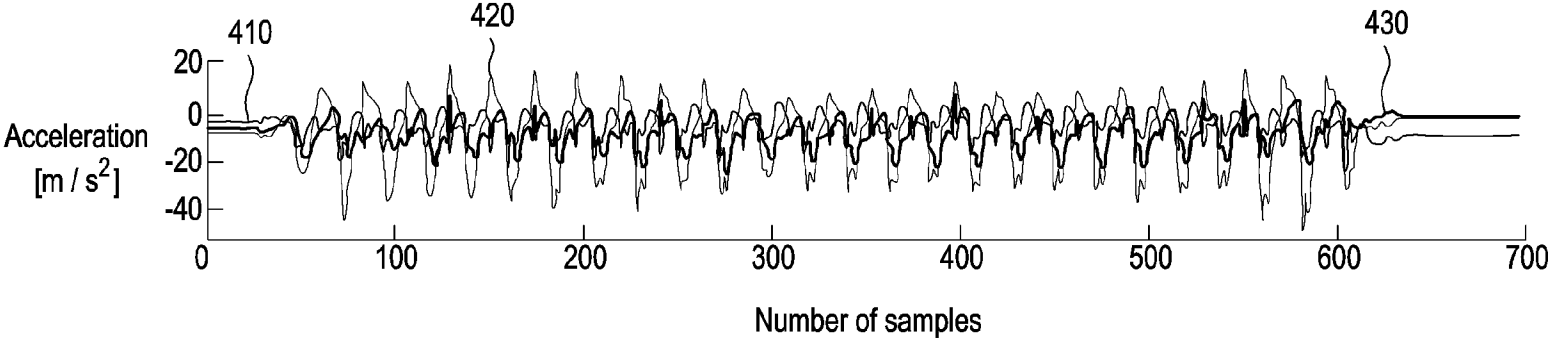
FIG. 4A illustrates example acceleration data obtained by a wearable electronic device according to an embodiment when a user jumps with both feet together.

FIG. 4A illustrates example acceleration data obtained by a wearable electronic device according to an embodiment when a user jumps with both feet together. Referring to FIG. 4A, it may be seen that the patterns of the x-direction component 410 of the acceleration, the y-direction component 420 of the acceleration, and the z-direction component 430 of the acceleration are repeated at regular intervals when the user jumps with both feet together. Further, it may be seen that the y-direction component 420 of the acceleration changes more than the x-direction component 410 of the acceleration and the z-direction component 430 of the acceleration. This may indicate that the motion of the y-direction component is dominant in jumping with both feet together.

Figure 5A:
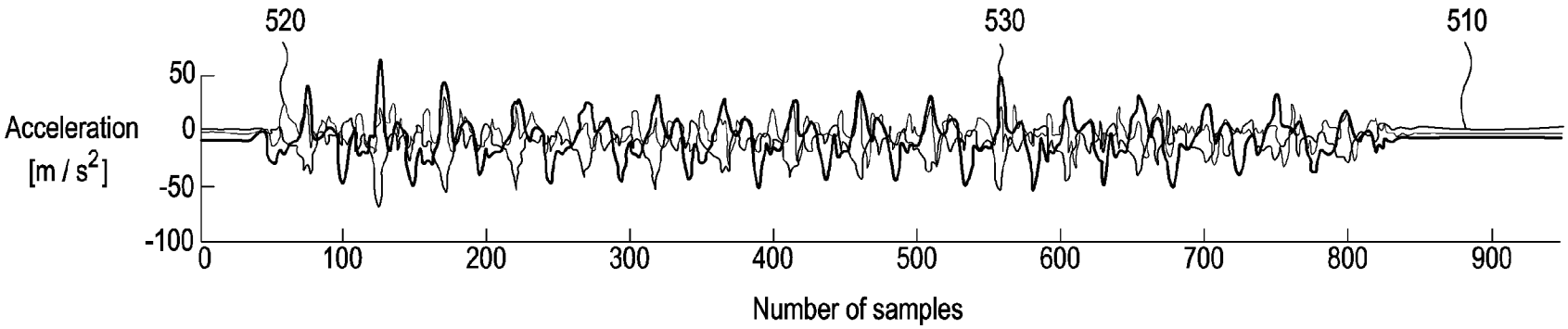
FIG. 5A illustrates example acceleration data obtained by a wearable electronic device according to an embodiment when a user does jump rope criss cross.

FIG. 5A illustrates example acceleration data obtained by a wearable electronic device according to an embodiment when a user does jump rope criss cross. Referring to FIG. 5A, it may be seen that the patterns of the x-direction component 510 of the acceleration, the y-direction component 520 of the acceleration, and the z-direction component 530 of the acceleration are repeated at regular intervals when the user does the jump rope criss cross. Unlike the jump with both feet together shown in FIG. 4A, referring to FIG. 5A, the x-direction component 510 of acceleration, the y-direction component 520 of acceleration, and the z-direction component 530 of acceleration are similar in magnitude. This may indicate that the magnitudes of the x-, y-, and z-direction components in the jump rope criss cross are similar to each other.

In operation 320, the at least one processor (e.g., the processor 120) of the wearable electronic device (e.g., the electronic device 101) may identify the magnitude of acceleration.

In operation 330, the at least one processor (e.g., the processor 120) of the wearable electronic device (e.g., the electronic device 101) may identify the SWS difference value based on the magnitude of the acceleration.

In operation 340, the at least one processor (e.g., the processor 120) of the wearable electronic device (e.g., the electronic device 101) may identify ZC points of the SWS difference value.

In operation 350, the at least one processor (e.g., the processor 120) of the wearable electronic device (e.g., the electronic device 101) may identify whether the intervals between adjacent ZC points are constant. According to an embodiment, the at least one processor 120 may identify time intervals corresponding between adjacent ZC points among the identified ZC points identified in operation 340, and may identify that the intervals between the adjacent ZC points are constant when the deviation between the corresponding time intervals between the identified adjacent ZC points is equal to or less than a predetermined level.

When it is identified that the intervals between adjacent ZC points are constant in operation 350, the at least one processor (e.g., the processor 120) of the wearable electronic device (e.g., the electronic device 101) may identify that the user of the wearable electronic device is doing a jump rope exercise in operation 360.

When it is identified that the intervals between adjacent ZC points are not constant in operation 350, the at least one processor (e.g., the processor 120) of the wearable electronic device (e.g., the electronic device 101) may identify that the user of the wearable electronic device is not doing a jump rope exercise in operation 370.

Figure 4B:
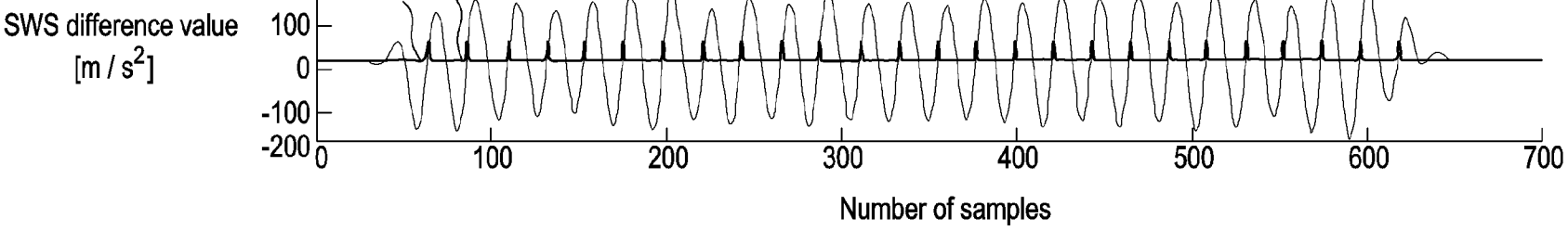
FIG. 4B illustrates an example SWS difference value identified by a wearable electronic device according to an embodiment when a user jumps both feet together.

FIG. 4B illustrates an example SWS difference value identified by a wearable electronic device according to an embodiment when a user jumps both feet together. The curve 440 of FIG. 4B is an SWS difference value identified based on the acceleration data illustrated in FIG. 4A. In FIG. 4B, the ZC points 451 and 452 are displayed, and it may be seen that the interval between the adjacent ZC points 451 and 452 is constant.

Figure 5B:
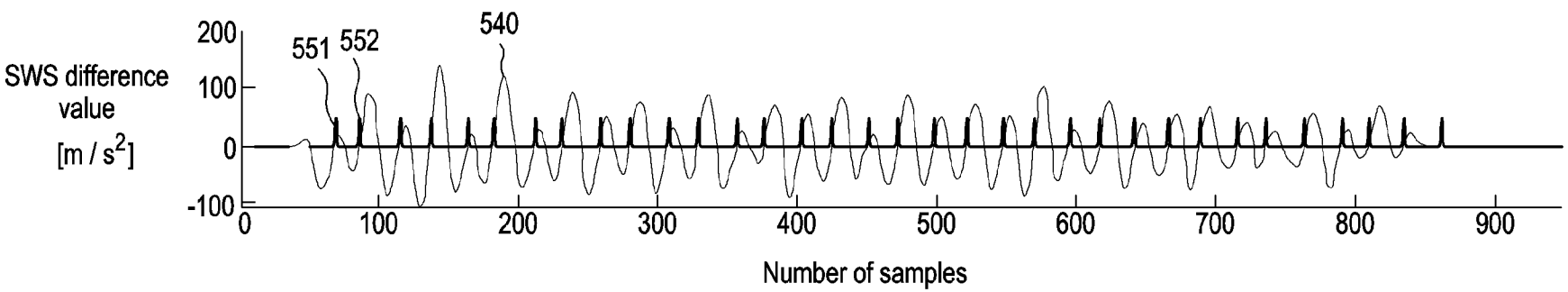
FIG. 5B illustrates an example SWS difference value identified by a wearable electronic device according to an embodiment when a user does jump rope criss cross.

FIG. 5B illustrates an example SWS difference value identified by a wearable electronic device according to an embodiment when a user does jump rope criss cross. The curve 540 of FIG. 5B is an SWS difference value identified based on the acceleration data illustrated in FIG. In FIG. 5B, the ZC points 551 and 552 are displayed, and it may be seen that the interval between the adjacent ZC points 551 and 552 is constant.

Figure 8:
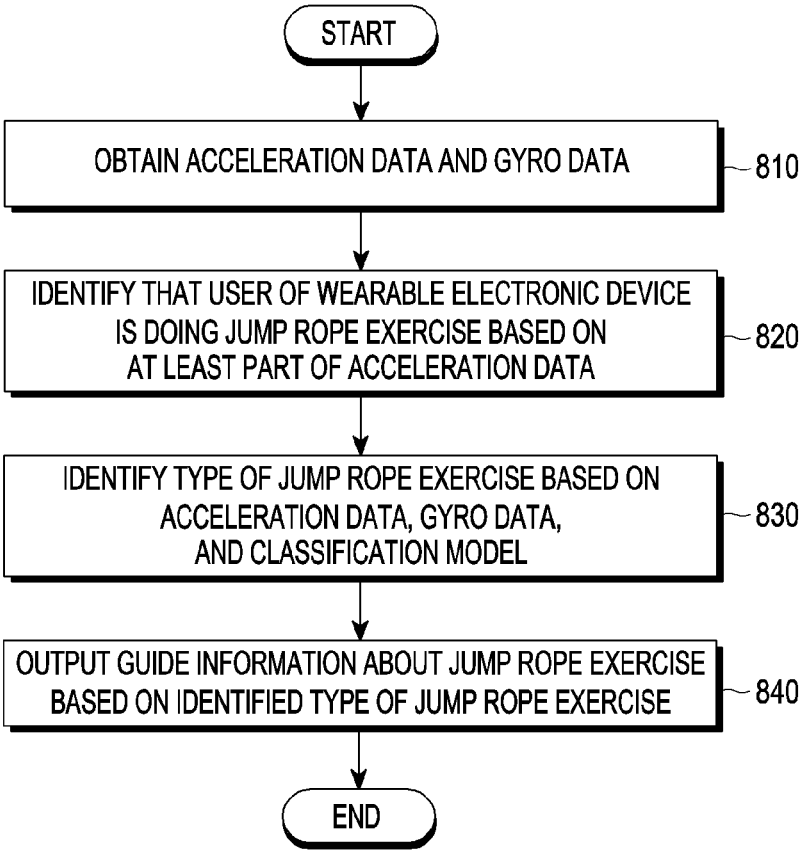
FIG. 8 is a flowchart illustrating operations performed in a wearable electronic device according to an embodiment.

FIG. 8 is a flowchart illustrating operations performed in a wearable electronic device according to an embodiment. In operation 810, the at least one processor (e.g., the processor 120) of the wearable electronic device (e.g., the electronic device 101) may obtain acceleration data through the acceleration sensor and may obtain gyro data through the gyro sensor.

In operation 820, the at least one processor (e.g., the processor 120) of the wearable electronic device (e.g., the electronic device 101) may identify that the user of the wearable electronic device is doing a jump rope exercise, based at least in part on acceleration data. Details of operation 220 of FIG. 2 and operations described with reference to FIG. 3 may be equally applied to operation 820.

In operation 830, the at least one processor (e.g., the processor 120) of the wearable electronic device (e.g., the electronic device 101) may identify the type of jump rope exercise based on acceleration data, gyro data, and a classification model. According to an embodiment, the at least one processor 120 may identify at least one first feature value based on the acceleration data, and identify at least one second feature value based on the gyro data.

According to an embodiment, the type of the jumping rope exercise may include at least one of jumping with both feet together, jump rope criss cross, double under, or alternate foot jump.

According to an embodiment, the at least one first feature value may include at least one of an average, variance, maximum value, minimum value, deviation, skewness, kurtosis, or repetition period of acceleration components indicated by data of a dominant axis among acceleration data or acceleration data reproduced by synthesis of one or more axes. According to an embodiment, the at least one first feature value may include at least one of an average, variance, maximum value, minimum value, deviation, skewness, kurtosis, or repetition period of acceleration magnitudes indicated by the acceleration data.

Figure 9A:
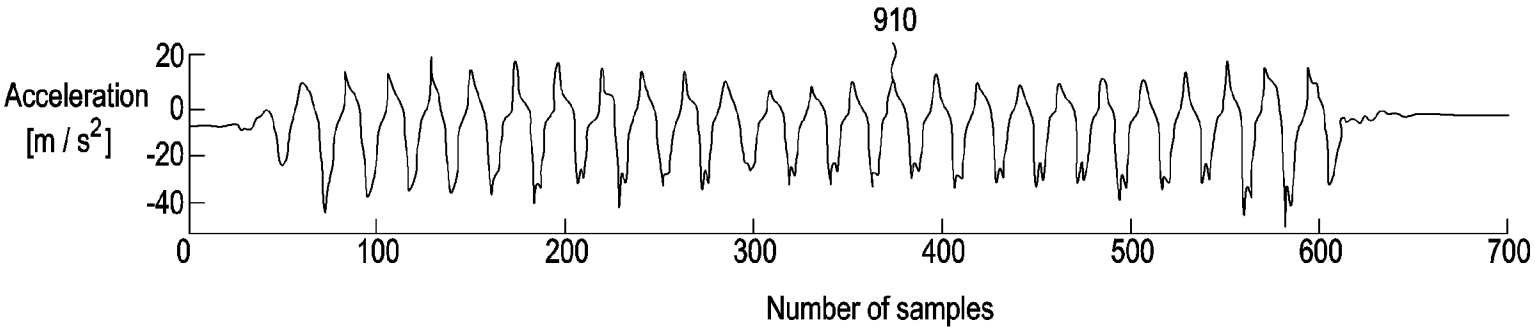
FIG. 9A illustrates part of example acceleration data obtained by a wearable electronic device according to an embodiment when a user jumps with both feet together.
Figure 10A:
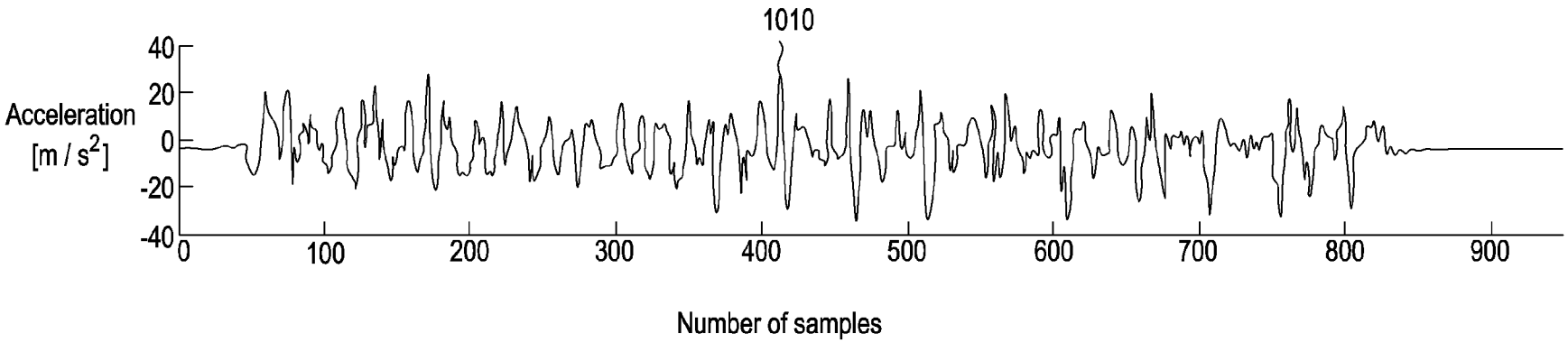
FIG. 10A illustrates part of example acceleration data obtained by a wearable electronic device according to an embodiment when a user does jump rope criss cross.
Figure 11A:
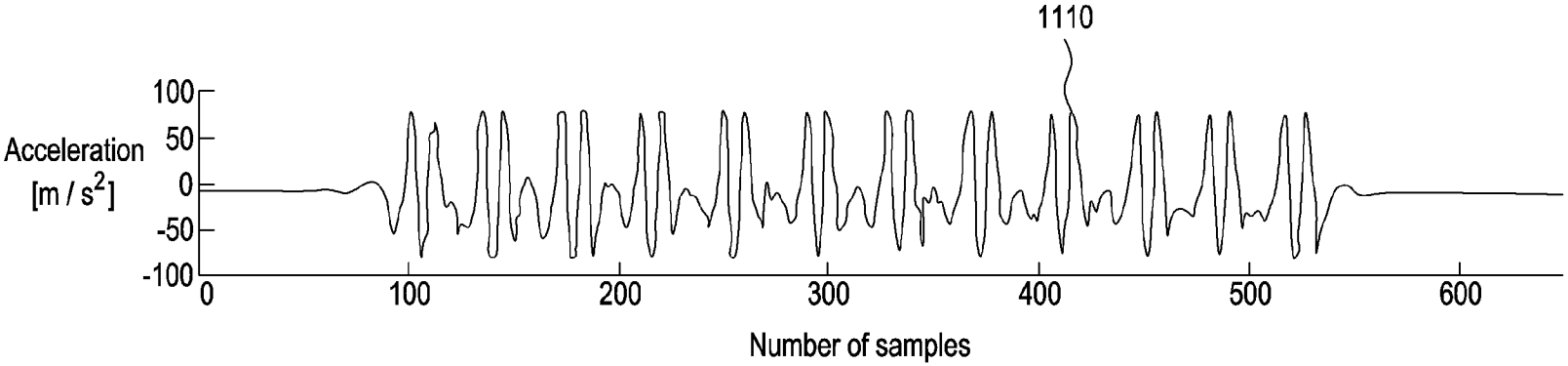
FIG. 11A illustrates part of example acceleration data obtained by a wearable electronic device according to an embodiment when a user does a double under.

FIG. 9A illustrates y-axis acceleration data which is part of example acceleration data obtained by a wearable electronic device according to an embodiment when a user jumps with both feet together. Referring to FIG. 9A, a curve 910 indicates a y-direction component of acceleration corresponding to y-axis acceleration data. FIG. 10A illustrates y-axis acceleration data which is part of example acceleration data obtained by a wearable electronic device according to an embodiment when a user does jump rope criss cross. Referring to FIG. 10A, a curve 1010 indicates a y-direction component of acceleration corresponding to y-axis acceleration data. FIG. 11A illustrates y-axis acceleration data which is part of example acceleration data obtained by a wearable electronic device according to an embodiment when a user does a double under. Referring to FIG. 11A, a curve 1110 indicates a y-direction component of acceleration corresponding to y-axis acceleration data.

According to an embodiment, the at least one second feature value may include at least one of an average, variance, maximum value, minimum value, deviation, skewness, kurtosis, or repetition period of angular acceleration components indicated by data of a dominant axis among gyro data or gyro data reproduced by synthesis of one or more axes. According to an embodiment, the at least one second feature value may include at least one of an average, variance, maximum value, minimum value, deviation, skewness, kurtosis, or repetition period of angular acceleration magnitudes indicated by the gyro data.

Figure 9B:
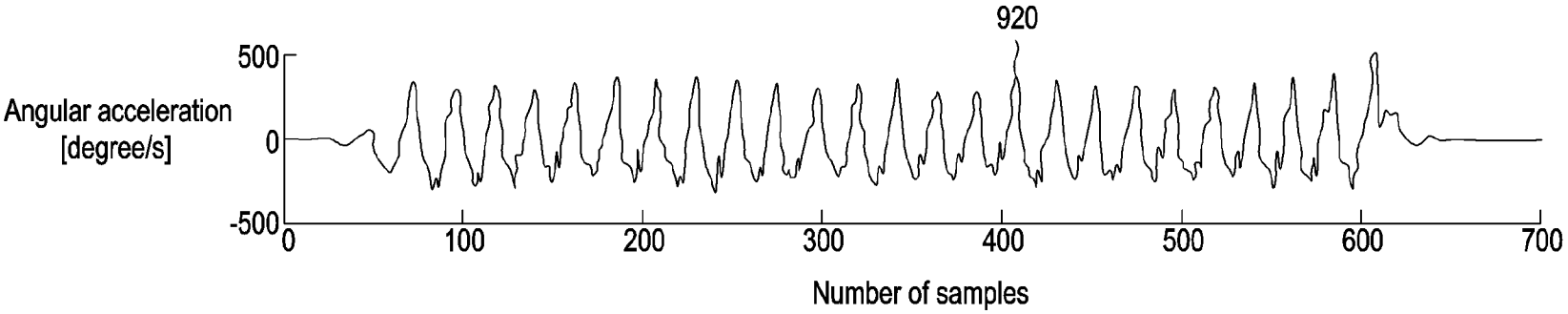
FIG. 9B illustrates part of example gyro data identified by a wearable electronic device according to an embodiment when a user jumps both feet together.
Figure 10B:
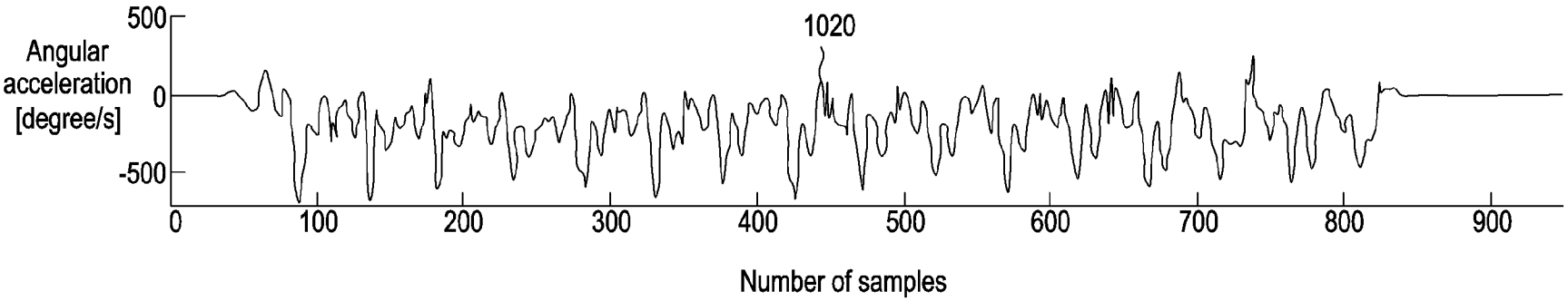
FIG. 10B illustrates part of example gyro data identified by a wearable electronic device according to an embodiment when a user does jump rope criss cross.
Figure 11B:
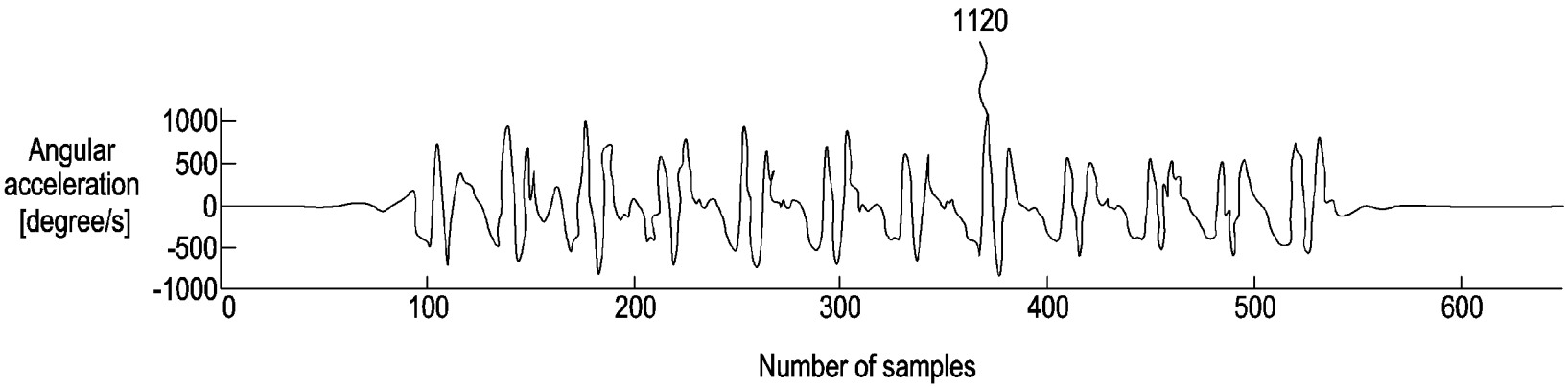
FIG. 11B illustrates part of example gyro data identified by a wearable electronic device according to an embodiment when a user does a double under.

FIG. 9B illustrates y-axis gyro data which is part of example gyro data obtained by a wearable electronic device according to an embodiment when a user jumps with both feet together. Referring to FIG. 9B, a curve 920 indicates a y-direction component of angular acceleration corresponding to y-axis gyro data. FIG. 10B illustrates y-axis gyro data which is part of example gyro data obtained by a wearable electronic device according to an embodiment when a user does jump rope criss cross. Referring to FIG. 10B, a curve 1020 indicates a y-direction component of acceleration corresponding to y-axis acceleration data. FIG. 11B illustrates y-axis gyro data which is part of example gyro data obtained by a wearable electronic device according to an embodiment when a user does a double under. Referring to FIG. 11B, a curve 1120 indicates a y-direction component of acceleration corresponding to y-axis acceleration data.

The classification model may receive at least one first feature value and at least one second feature value and output the type of jump rope exercise. According to an embodiment, various machine learning techniques may be used to identify the classification model. For example, the classification model may be identified using DTs, SVM, KNN, and/or MLP.

According to an embodiment, the classification model may be generated by the machine learning engine 1650*a* to be described below with reference to FIG. 16A and may be stored in a memory (e.g., the memory 130) of the wearable electronic device 101, or may be stored in an external electronic device (e.g., the electronic device 104) other than the wearable electronic device 101. When the classification model is stored in the memory 130 of the wearable electronic device 101, the at least one processor 120 may identify the type of jump rope exercise by referring to the classification model stored in the memory 130. When the classification model is stored in the external electronic device 104, the at least one processor 120 may control the communication module 190 to transmit the at least one first feature value and the at least one second feature value to the external electronic device 104 via a network (e.g., the second network 199) and to receive the type of jump rope exercise from the external electronic device 104.

For example, the classification model may have the variance of the acceleration magnitude and the variance of the angular acceleration magnitude as input parameters. An example classification model may identify that the type of the jump rope exercise is jump with both feet together if the variance of the angular acceleration magnitude is a specific first value or less, identify that the type of the jump rope exercise is jump rope criss cross if the variance of the angular acceleration magnitude is a specific second value or less, and identify that the type of the jump rope exercise is double under if the variance of the angular acceleration magnitude exceeds the specific first value and the variance of the acceleration magnitude exceeds the specific second value.

In operation 840, the at least one processor (e.g., the processor 120) of the wearable electronic device (e.g., the electronic device 101) may output guide information about the jump rope exercise based on the identified type of the jump rope exercise.

According to an embodiment, the at least one processor 120 may output guide information by controlling a display (e.g., the display module 160) to visually display the guide information. According to an embodiment, the at least one processor 120 may output guide information by controlling a sound output module (e.g., the sound output module 155) to output a voice corresponding to the guide information. According to an embodiment, the at least one processor 120 may output the guide information by controlling the communication module 190 to transmit the guide information to another electronic device 104 such that the guide information is output through the other electronic device (e.g., the electronic device 104).

Figure 12A:
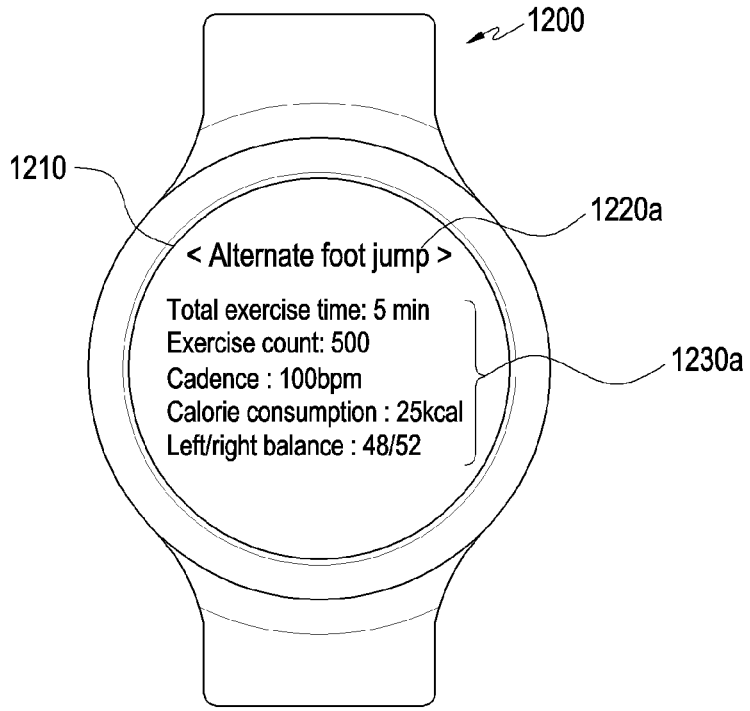
FIG. 12A illustrates a wearable electronic device outputting example guide information according to an embodiment.

FIG. 12A illustrates a wearable electronic device outputting example guide information according to an embodiment. Referring to FIG. 12A, the at least one processor 120 of the wearable electronic device 1200 may display a set 1230*a* of information corresponding to the identified type 1220*a* of jump rope exercise, along with the identified 1220*a* of jump rope exercise, as guide information on the display 1210, based on identifying that the type of jump rope exercise is alternate foot jump.

According to an embodiment, the memory 130 of the wearable electronic device (e.g., the electronic device 101) may store a correlation between the types of jump rope exercises and sets of information corresponding to the types of jump rope exercises. For example, the stored correlation may be information represented in Table 1.

TABLE 1

| Type of jump rope exercise | Set of information |
|---|---|
| Jump with both feet together | Number of jump ropes, number of jump ropes per minute, time required for jump rope exercise, time of contacting the ground, time of staying in the air, maximum impact amount, isokineticity |
| Jump rope criss cross | Number of jump ropes, number of jump ropes per minute, time required for jump rope exercise, time of staying in the air, maximum impact amount, isokineticity |
| Double under | Number of jump ropes, number of jump ropes per minute, time required for jump rope exercise, time of staying in the air, maximum impact amount, isokineticity |
| Alternate foot jump | Number of jump ropes, number of jump ropes per minute, time required for jump rope exercise, time of contacting the ground, time of staying in the air, maximum impact amount, left/right balance, isokineticity |

Figure 12B:
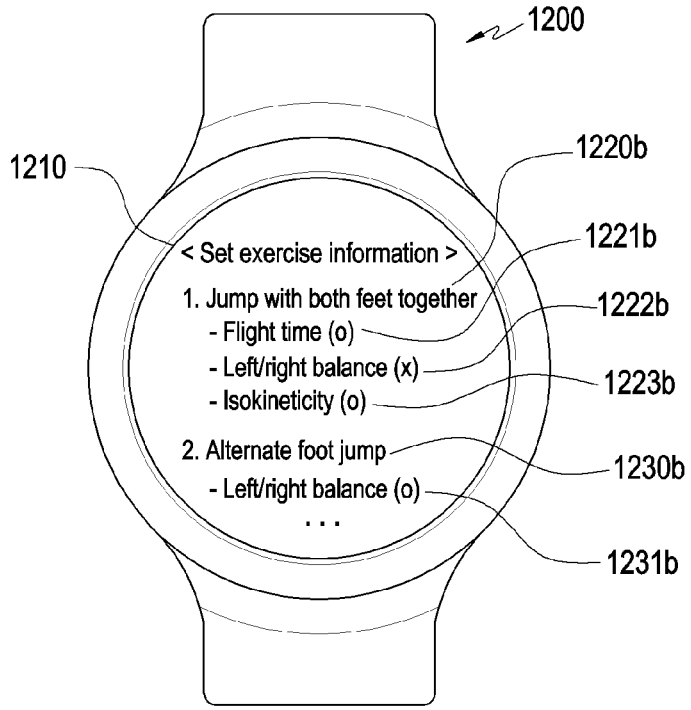
FIG. 12B illustrates a screen for setting a correlation between the type of a jump rope exercise and a set of output information according to an embodiment.

According to an embodiment, the at least one processor 120 may display an interface through which the user of the wearable electronic device (e.g., the electronic device 101) may set a correlation between the type of jump rope exercise and the set of output information, and may store the correlation between the type of jump rope exercise and the set of output information according to a user input. FIG. 12B illustrates a screen for setting the correlation between the type of jump rope exercise and the set of output information according to an embodiment. Referring to FIG. 12B, on the screen displayed on the display 1210 of the wearable electronic device 1200, information that may be displayed as guide information when the type of jump rope exercise is identified as a first type 1220*b* and interfaces 1221*b*, 1222*b*, and 1223*b* for setting whether to display each piece of information on the guide information when the type of jump rope exercise is identified as the first type 1220*b* may be displayed, together with the first type 1220*b* of the jump rope exercise. Referring to FIG. 12B, on the screen displayed on the display 1210, information that may be displayed as guide information when the type of jump rope exercise is identified as a second type 1230*b* and an interface 123 lb for setting whether to display each piece of information on the guide information when the type of jump rope exercise is identified as the second type 1230*b* may be displayed, together with the second type 1230*b* of the jump rope exercise.

Figure 13A:
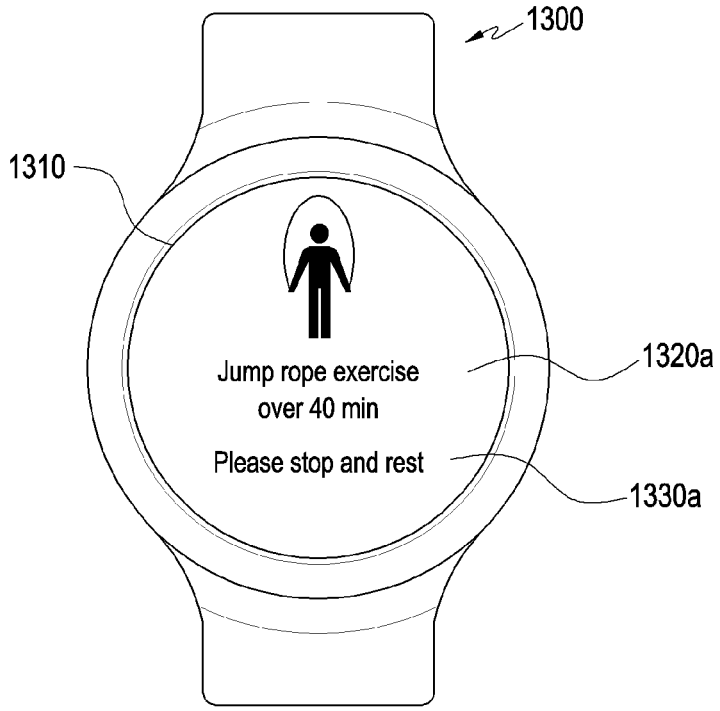
FIG. 13A illustrates a wearable electronic device outputting example guide information according to an embodiment.
Figure 13B:
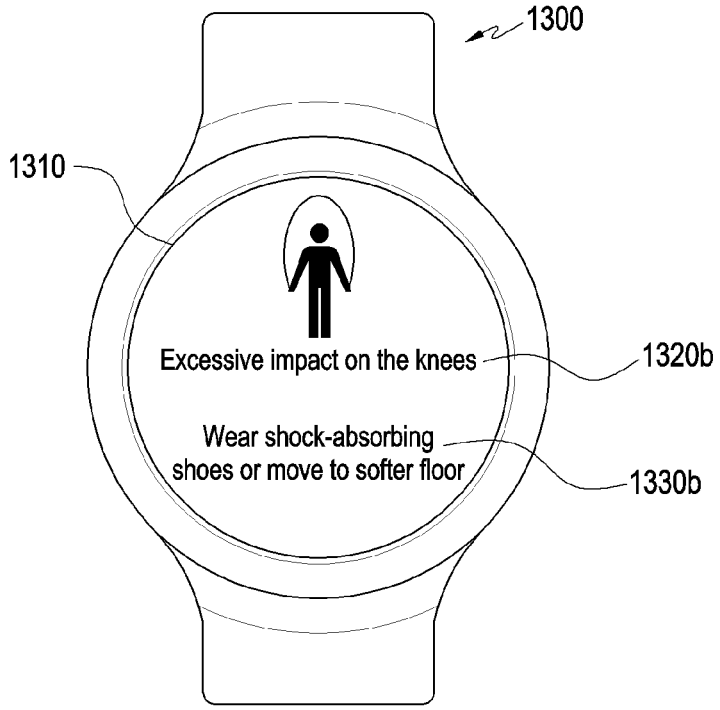
FIG. 13B illustrates a wearable electronic device outputting example guide information according to an embodiment.

FIGS. 13A and 13B illustrate a wearable electronic device outputting example guide information according to an embodiment. According to an embodiment, the at least one processor (e.g., the processor 120) of the wearable electronic device (e.g., the electronic device 101) may identify the required time of the jump rope exercise and output guide information in response to the required time of the jump rope exercise exceeding a preset threshold. For example, as illustrated in FIG. 13A, the at least one processor 120 of the wearable electronic device 1300 may display, on the display 1310, a message 1320*a* for indicating that the time required for the jump rope exercise exceeds the preset threshold and a message 1330*a* for recommending a rest.

According to an embodiment, the at least one processor (e.g., the processor 120) of the wearable electronic device (e.g., the electronic device 101) may identify the maximum impact amount of the jump rope exercise and output guide information in response to the maximum impact amount of the jump rope exercise exceeding a preset threshold. When the maximum impact amount exceeds the threshold, a large impact may be transferred to the user's knee, which may adversely affect the user's knee health. For example, as illustrated in FIG. 13B, the at least one processor 120 of the wearable electronic device 1300 may display a message 1320*b* for indicating that the maximum impact amount exceeds a threshold and a message 1330*b* for indicating a method for reducing the impact amount on the display 1310.

Figure 14A:
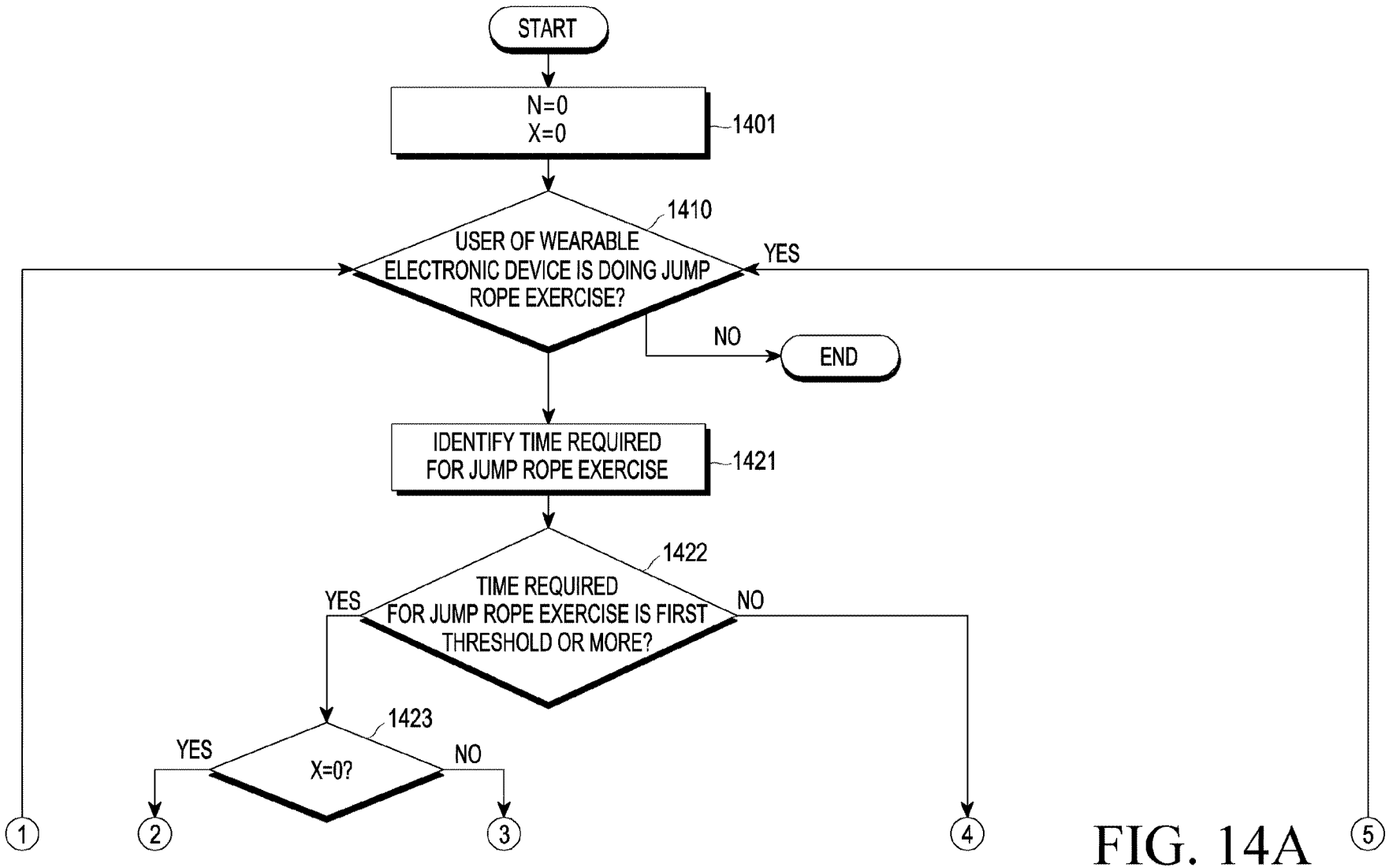
FIG. 14A is a flowchart illustrating operations performed in a wearable electronic device according to an embodiment.
Figure 14B:
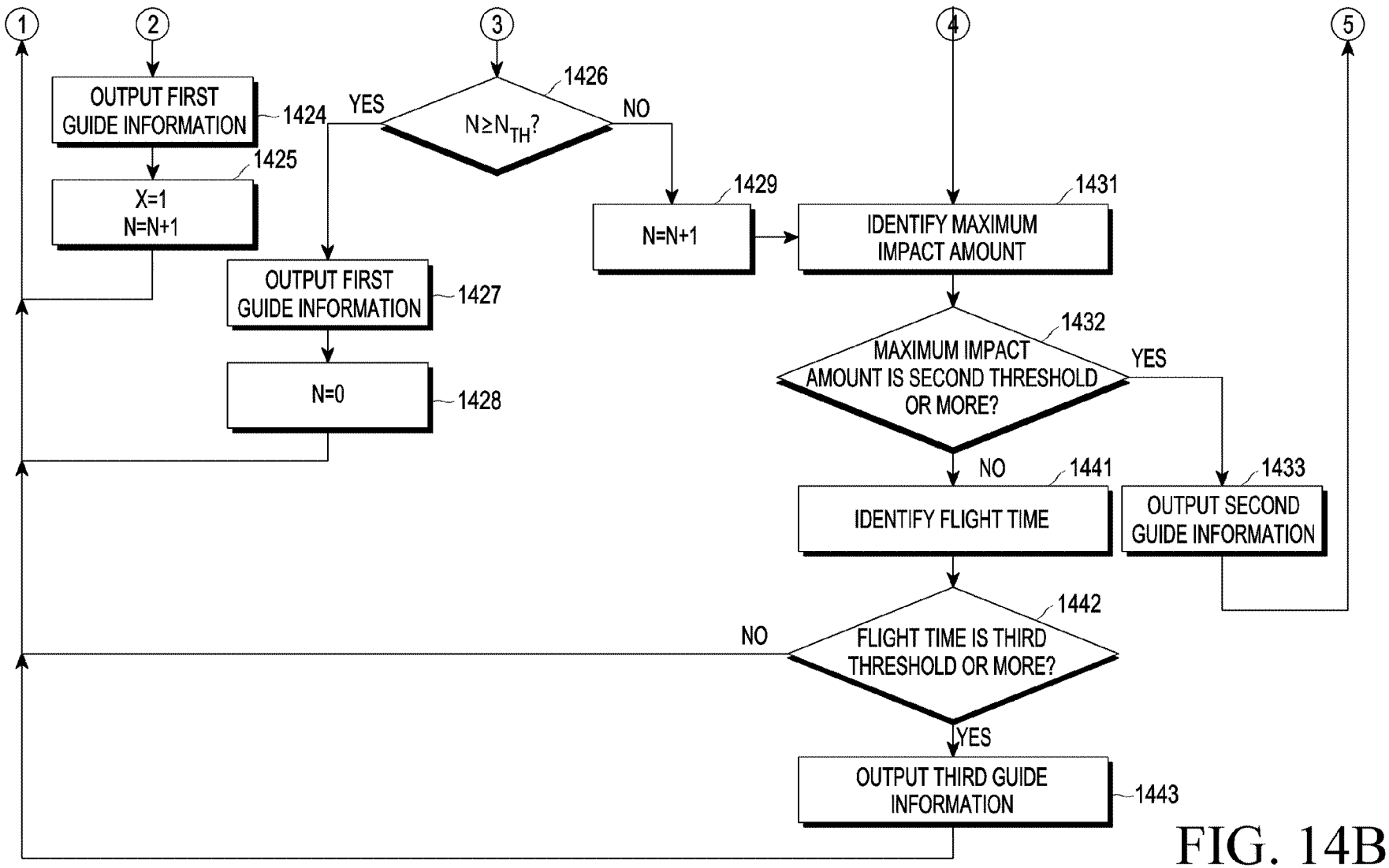
FIG. 14B is a flowchart illustrating operations performed in a wearable electronic device according to an embodiment.

FIGS. 14A and 14B are flowcharts illustrating operations performed in a wearable electronic device according to an embodiment. In operation 1401, the at least one processor (e.g., the processor 120) of the wearable electronic device (e.g., the electronic device 101) may set the value of the variable N to 0 and may set the value of the variable X to 0. As is described below with reference to operations 1422 to 1429, if the required time of the jump rope exercise is greater than or equal to the first threshold, the value of the variable X changes from 0 to 1 after the first guide information is output in operation 1424. In other words, when the value of the variable X is 0, it indicates that the first output of the first guide information does not occur after the required time of the jump rope exercise is greater than or equal to the first threshold, and when the value of the variable X is 1, it indicates that the first output of the first guide information occurs. The variable N may be a counter indicating a time elapsed after initially outputting the first guide information in operation 1424 or outputting the first guide information in operation 1427.

In operation 1410, the at least one processor (e.g., the processor 120) of the wearable electronic device (e.g., the electronic device 101) may identify whether the user of the wearable electronic device is doing a jump rope exercise. A method of identifying whether the user is doing a jump rope exercise has been described above with reference to operation 220 of FIG. 2 and FIG. 3.

When it is identified in operation 1410 that the user of the wearable electronic device is not doing the jump rope exercise, the at least one processor (e.g., the processor 120) of the wearable electronic device (e.g., the electronic device 101) may terminate the method without performing any other operation.

When it is identified that the user of the wearable electronic device is doing the jump rope exercise in operation 1410, the at least one processor (e.g., the processor 120) of the wearable electronic device (e.g., the electronic device 101) may identify the required time of the jump rope exercise in operation 1421. A method of identifying the time required for the jump rope exercise has been described above.

In operation 1422, the at least one processor (e.g., the processor 120) of the wearable electronic device (e.g., the electronic device 101) may identify whether the time required for the jump rope exercise is greater than or equal to a first threshold.

When it is identified that the time required for the jump rope exercise is greater than or equal to the first threshold in operation 1422, the at least one processor (e.g., the processor 120) of the wearable electronic device (e.g., the electronic device 101) may identify whether the value of the variable X is 0 in operation 1423. When the value of the variable X is 0, the at least one processor 120 may output the first guide information in operation 1424. According to an embodiment, the at least one processor 120 may display a screen as illustrated in FIG. 13A on a display (e.g., the display module 160) as first guide information. After performing operation 1424, the at least one processor 120 may set the value of the variable X to 1, may increase the count of the variable N by 1, and may return to operation 1410 in operation 1425.

When it is identified that the value of the variable X is not 0 in operation 1423, the at least one processor 120 may identify whether the value of the variable N is equal to or greater than the threshold NTH in operation 1426. When the value of the variable N is equal to or greater than the threshold NTH, the at least one processor 120 may output the first guide information in operation 1427, may set the value of the variable N to 0 in operation 1428, and may return to operation 1410.

When it is identified that the value of the variable N is less than the threshold NTH in operation 1426, the at least one processor 120 may perform operation 1431 after increasing the count of the variable N by 1 in operation 1429.

When it is identified that the time required for the jump rope exercise is less than the first threshold in operation 1422, the at least one processor (e.g., the processor 120) of the wearable electronic device (e.g., the electronic device 101) may identify the maximum impact amount in operation 1431.

In operation 1432, the at least one processor (e.g., the processor 120) of the wearable electronic device (e.g., the electronic device 101) may identify whether the maximum impact amount is greater than or equal to a second threshold.

When it is identified that the maximum impact amount is equal to or greater than the second threshold in operation 1432, the at least one processor (e.g., the processor 120) of the wearable electronic device (e.g., the electronic device 101) may output the second guide information in operation 1433. According to an embodiment, the at least one processor 120 may display a screen as illustrated in FIG. 13B on a display (e.g., the display module 160) as second guide information. After performing operation 1433, the at least one processor 120 may return to operation 1410.

When it is identified that the maximum impact amount is less than the second threshold in operation 1432, the at least one processor (e.g., the processor 120) of the wearable electronic device (e.g., the electronic device 101) may identify the time of staying in the air in operation 1441.

In operation 1442, the at least one processor (e.g., the processor 120) of the wearable electronic device (e.g., the electronic device 101) may identify whether the time of staying in the air is greater than or equal to a third threshold.

When it is identified that the time of staying in the air is greater than or equal to the third threshold in operation 1442, the at least one processor (e.g., the processor 120) of the wearable electronic device (e.g., the electronic device 101) may output the third guide information in operation 1443. According to an embodiment, the at least one processor 120 may display a screen as illustrated in FIG. 7A on a display (e.g., the display module 160) as second guide information. After performing operation 1443, the at least one processor 120 may return to operation 1410.

Although FIG. 14A and FIG. 14B illustrate an embodiment in which guide information is displayed based on the required time, the maximum amount of impact, and the time of staying in the air of the jump rope exercise, according to an embodiment, a combination of various parameters in addition to the required time, the maximum amount of impact, and the time of staying in the air of the jump rope exercise may be used as conditions for displaying guide information. Further, in FIGS. 14A and 14B, an embodiment in which the required time of the jump rope exercise, the maximum amount of impact, and the next time of staying in the air are identified in the order thereof has been described, but according to an embodiment, the order in which various parameters used as conditions for displaying guide information are identified is not limited.

Figure 15:
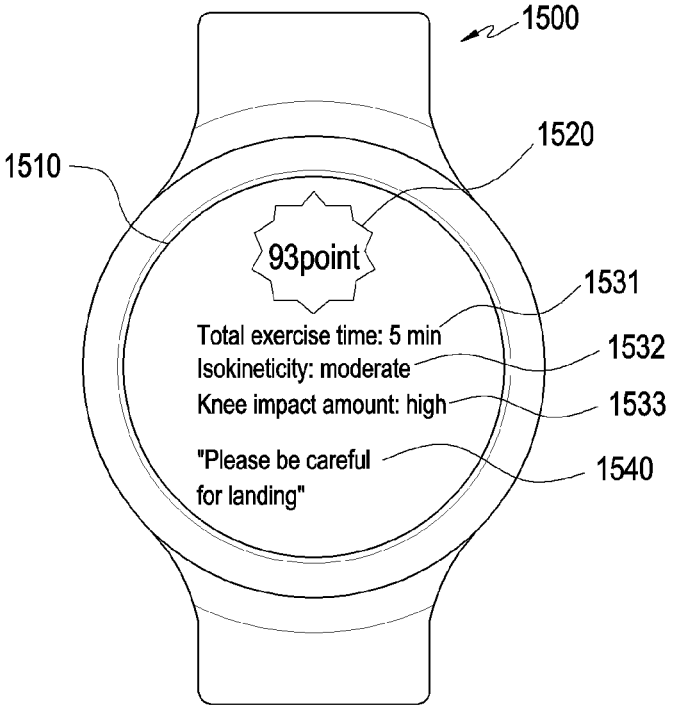
FIG. 15 illustrates a wearable electronic device outputting example guide information according to an embodiment.

FIG. 15 illustrates a wearable electronic device outputting example guide information according to an embodiment. According to an embodiment, the at least one processor (e.g., the processor 120) of the wearable electronic device (e.g., the electronic device 101) may calculate a score for evaluating a jump rope exercise based on at least one parameter and output the calculated score. According to an embodiment, the at least one parameter used to calculate the score may include at least one of a type of jump rope exercise, a time required for the jump rope exercise, the number of jump ropes, the number of jump ropes per minute, a maximum impact amount, a left/right balance, isokineticity, a time of staying in the air, a ground touch time, or a jump frequency.

For example, as illustrated in FIG. 15, the at least one processor 120 of the wearable electronic device 1500 may display the calculated score 1520 and a message 1530 corresponding to the score 1520 on the display 1510.

Referring to FIG. 15, the at least one processor 120 of the wearable electronic device 1500 may display information related to the jump rope exercise on the display 1510. According to an embodiment, in addition to the total exercise time 1531, the isokineticity 1532, and/or the knee impact amount 1533 illustrated in FIG. 15, various parameters related to the jump rope exercise may be displayed on the display 1510.

The at least one processor 120 of the wearable electronic device 1500 may display, on the display 1510, a message 1540 for guiding the user for a preferred jump rope exercise. The message 1540 illustrated in FIG. 15 may be displayed according to the knee impact amount 1533.

According to an embodiment, the at least one processor 120 of the wearable electronic device 1500 may display a message 1540 in response to the knee impact amount exceeding a predetermined specific value. According to an embodiment, the predetermined specific value may be determined using a machine learning engine 1650*a* and a motion analysis engine 1620*a*, which are described below with reference to FIG. 16A.

Although not illustrated in FIG. 15, according to an embodiment, the at least one processor 120 of the wearable electronic device 1500 may output, in addition to the message 1540 corresponding to the knee impact amount 1533, a message corresponding to at least one of the required time of the jump rope exercise, the number of jump ropes, the number of jump ropes per minute, the left/right balance, the isokineticity, the time of staying in the air, the time of contacting the ground, or the jump frequency.

In an embodiment, the at least one processor 120 of the wearable electronic device 1500 may share the calculated score 1520 with an external electronic device registered in the electronic device 1500. For example, the processor 210 may provide the calculated score 1520 and/or data related to the score 1520 to an external electronic device of a family member and/or an acquaintance. The at least one processor 120 of the wearable electronic device 1500 may transmit the score 1520 and/or the data to a server. The at least one processor 120 of the wearable electronic device 1500 may receive feedback on jumping rope from the external electronic device of the family member and/or the acquaintance. For example, the at least one processor 120 of the wearable electronic device 1500 may transmit data on the calculated score 1520 to an external electronic device registered as a guardian of the user of the electronic device 1500 through the server. The external electronic device registered as the guardian may monitor the electronic device 1500 based on the received data.

In an embodiment, the electronic device 1500 may provide a notification related to the interface through an external device operatively connected, directly or indirectly, to the electronic device 1500. For example, the electronic device 1500 may provide the notification through an external device connected through short-range communication (e.g., Wi-Fi or Bluetooth) in an Internet of things (IoT) environment. The electronic device 1500 may provide the notification through an external device connected on the same account in the server.

Figure 16A:
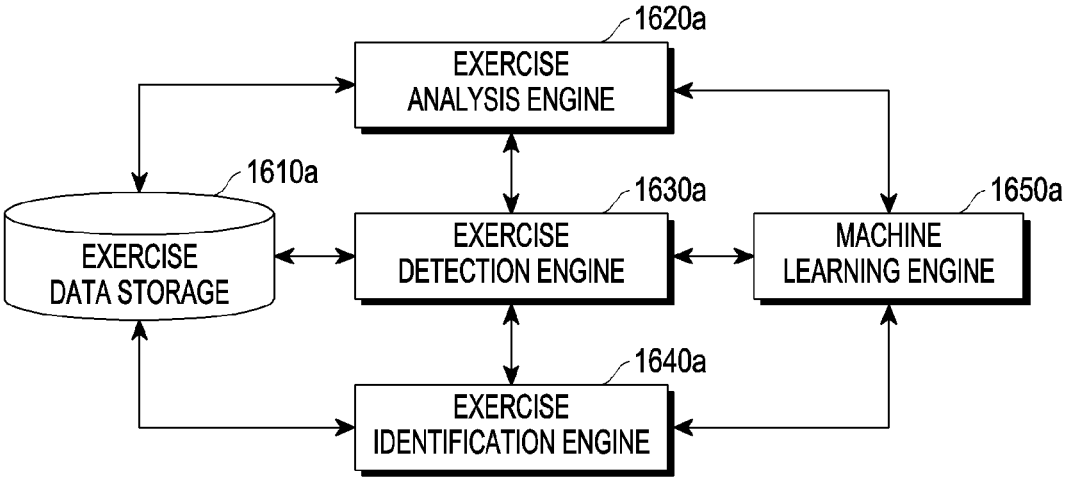
FIG. 16A is a block diagram illustrating a wearable electronic device according to an embodiment.

FIG. 16A is a block diagram illustrating a wearable electronic device according to an embodiment. A wearable electronic device (e.g., the electronic device 101) according to an embodiment may include an exercise data storage 1610*a*, an exercise analysis engine 1620*a*, an exercise detection engine 1630*a*, an exercise identification engine 1640*a*, and a machine learning engine 1650*a*.

According to an embodiment, the exercise data storage 1610*a* may be included in a memory (e.g., the memory 130) of the wearable electronic device 101. According to an embodiment, the exercise analysis engine 1620*a*, the exercise detection engine 1630*a*, the exercise identification engine 1640*a*, and the machine learning engine 1650*a* may be included in a processor (e.g., the processor 120) of the wearable electronic device 101.

According to an embodiment, the exercise data storage 1610*a* may store data obtained through the acceleration sensor and the gyro sensor of the wearable electronic device 101. According to an embodiment, the at least one processor (e.g., the processor 120) of the wearable electronic device 101 may calculate various parameters based at least partially on acceleration data and gyro data, and may store the calculation result of the parameters in the exercise data storage 1610*a*. Various parameters may include at least one of the ZC point of acceleration data or gyro data, the magnitude of acceleration, the magnitude of angular acceleration, the time of staying in the air, the time of contacting the ground, the jump frequency, the time required for the jump rope exercise, the SWS difference value of acceleration, the number of jump ropes per minute, the jump frequency, the maximum impact amount, the left/right balance, or isokineticity.

According to an embodiment, the data stored in the exercise data storage 1610*a* may be transferred to the exercise analysis engine 1620*a*, the exercise detection engine 1630*a*, the exercise identification engine 1640*a*, and the machine learning engine 1650*a*.

According to an embodiment, the machine learning engine 1650*a* may generate an exercise analysis model based on data stored in the exercise data storage 1610*a*. The exercise analysis model may be a model that receives a plurality of first parameters related to the jump rope exercise and outputs at least one second parameter related to an appropriate jump rope exercise. According to an embodiment, the plurality of first parameters may include two or more of the acceleration data, the gyro data, the ZC point of acceleration data or gyro data, the magnitude of acceleration, the magnitude of angular acceleration, the time of staying in the air, the time of contacting the ground, the jump frequency, the time required for the jump rope exercise, the SWS difference value of acceleration, the number of jump ropes per minute, the jump frequency, the maximum impact amount, the left/right balance, or isokineticity. According to an embodiment, the at least one second parameter may include at least one of a recommended time of staying in the air, a recommended impact amount, or a recommended exercise time for the user.

According to an embodiment, the exercise analysis engine 1620*a* may identify whether the current jump rope exercise is appropriate, based on the exercise analysis model generated by the machine learning engine 1650*a* and the currently obtained acceleration data and gyro data. According to an embodiment, when the exercise analysis engine 1620*a* identifies that the jump rope exercise currently performed is not appropriate, the processor 120 of the wearable electronic device 101 may output guide information about the jump rope exercise.

According to an embodiment, the machine learning engine 1650*a* may generate an exercise detection model based on data stored in the exercise data storage 1610*a*. The exercise detection model may be a model that receives a plurality of first parameters related to a jump rope exercise and outputs whether the jump rope exercise is being performed. According to an embodiment, the plurality of first parameters may include two or more of the acceleration data, the gyro data, the ZC point of acceleration data or gyro data, the magnitude of acceleration, the magnitude of angular acceleration, the time of staying in the air, the time of contacting the ground, the jump frequency, the time required for the jump rope exercise, the SWS difference value of acceleration, the number of jump ropes per minute, the jump frequency, the maximum impact amount, the left/right balance, or isokineticity.

According to an embodiment, the exercise detection engine 1630*a* may identify whether the current jump rope exercise is appropriate, based on the exercise detection model generated by the machine learning engine 1650*a* and the currently obtained acceleration data and gyro data.

According to an embodiment, the machine learning engine 1650*a* may generate an exercise identification model based on data stored in the exercise data storage 1610*a*. The exercise identification model may be a model that receives a plurality of first parameters related to a jump rope exercise and outputs the type of the jump rope exercise. According to an embodiment, the plurality of first parameters may include two or more of the acceleration data, the gyro data, the ZC point of acceleration data or gyro data, the magnitude of acceleration, the magnitude of angular acceleration, the time of staying in the air, the time of contacting the ground, the jump frequency, the time required for the jump rope exercise, the SWS difference value of acceleration, the number of jump ropes per minute, the jump frequency, the maximum impact amount, the left/right balance, or isokineticity. The type of the jumping rope exercise may include at least one of jumping with both feet together, jump rope criss cross, double under, or alternate foot jump. The classification model described above with reference to FIG. 8 may be included in the exercise identification model.

According to an embodiment, the exercise identification engine 1640*a* may identify the type of jump rope exercise currently being performed based on the exercise identification model generated by the machine learning engine 1650*a* and the currently obtained acceleration data and gyro data.

Figure 16B:
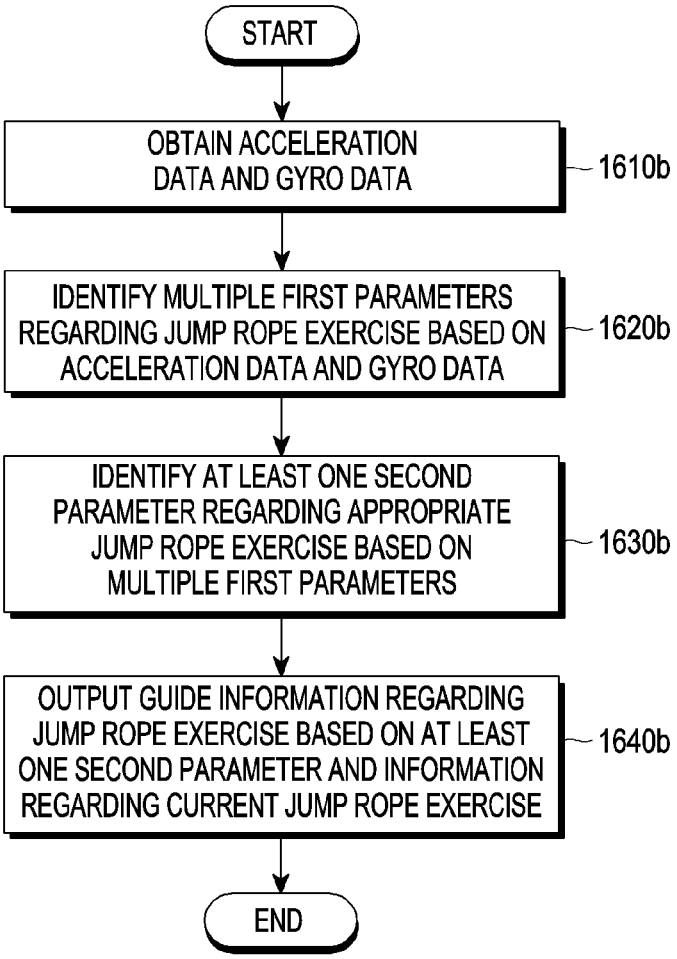
FIG. 16B is a flowchart illustrating operations performed in a wearable electronic device according to an embodiment.

FIG. 16B is a flowchart illustrating operations performed in a wearable electronic device according to an embodiment. In operation 1610*b*, the at least one processor (e.g., the processor 120) of the wearable electronic device (e.g., the electronic device 101) may obtain acceleration data through the acceleration sensor and may obtain gyro data through the gyro sensor.

In operation 1620*b*, the at least one processor 120 of the wearable electronic device 101 may identify a plurality of first parameters related to the jump rope exercise, based on the acceleration data and the gyro data. According to an embodiment, the plurality of first parameters may include at least one of the acceleration data, the gyro data, the ZC point of acceleration data or gyro data, the magnitude of acceleration, the magnitude of angular acceleration, the time of staying in the air, the time of contacting the ground, the jump frequency, the time required for the jump rope exercise, the SWS difference value of acceleration, the number of jump ropes per minute, the jump frequency, the maximum impact amount, the left/right balance, or isokineticity. According to an embodiment, the plurality of first parameters may further include at least one of the user's height, weight, age, or information about another exercise performed by the user.

In operation 1630*b*, the at least one processor 120 of the wearable electronic device 101 may identify at least one second parameter for an appropriate jump rope exercise based on the plurality of first parameters. According to an embodiment, the at least one second parameter may include at least one of a recommended time of staying in the air, a recommended impact amount, or a recommended exercise time for the user. According to an embodiment, the at least one processor 120 of the wearable electronic device 101 may identify at least one second parameter based on the exercise analysis model generated by the machine learning engine 1650*a*.

In operation 1640*b*, the at least one processor 120 of the wearable electronic device 101 may output guide information about the jump rope exercise, based on the at least one second parameter and information about the current jump rope exercise. According to an embodiment, the information about the current jump rope exercise may include acceleration data and gyro data obtained in real time during the jump rope exercise. According to an embodiment, the information about the current jump rope exercise may include various parameters identified based on acceleration data and gyro data obtained in real time during the jump rope exercise. Various parameters may include at least one of, e.g., the ZC point of acceleration data or gyro data, the magnitude of acceleration, the magnitude of angular acceleration, the time of staying in the air, the time of contacting the ground, the jump frequency, the time required for the jump rope exercise, the SWS difference value of acceleration, the number of jump ropes per minute, the jump frequency, the maximum impact amount, the left/right balance, or isokineticity.

For example, when the at least one processor 120 of the wearable electronic device 101 identifies the recommended impact amount as the second parameter and identifies that the impact amount identified based on the acceleration data for the current jump rope exercise is higher than the recommended impact amount, the at least one processor 120 may output guide information as illustrated in FIG. 13B. According to an embodiment, the at least one processor 120 may output the recommended impact amount and the impact amount identified based on the acceleration data for the current jump rope exercise as guide information. According to an embodiment, the at least one processor 120 may output the guide information in the form of the message 1540 illustrated in FIG. 15.

A wearable electronic device 101 according to an embodiment may comprise an acceleration sensor and at least one processor 120. The at least one processor 120 may be configured to obtain acceleration data through the acceleration sensor, identify that a user of the wearable electronic device 101 is doing a jump rope exercise based on at least a portion of the acceleration data, identify at least one of a time of staying in the air or a touch time of contacting a ground based on the acceleration data, and output guide information about the jump rope exercise based on at least one of the time of staying in the air or the time of contacting the ground.

According to an embodiment, the wearable electronic device 101 may further comprise a gyro sensor. The at least one processor 120 may be configured to obtain gyro data through the gyro sensor and identify that the user of the wearable electronic device 101 is doing the jump rope exercise based on the gyro data and the acceleration data.

According to an embodiment, the wearable electronic device 101 may further comprise a gyro sensor. The at least one processor 120 may be configured to obtain gyro data through the gyro sensor and identify a type of the jump rope exercise based on a classification model identified through machine learning, the gyro data, and the acceleration data.

According to an embodiment, the type of the jump rope exercise may include at least one of jumping with both feet together, jump rope criss cross, double under, or alternate foot jump.

According to an embodiment, the at least one processor 120 may be configured to identify a jump rope exercise session based on the acceleration data, identify at least one first feature value based on the acceleration data within the jump rope exercise session, identify at least one second feature value based on the gyro data within the jump rope exercise session, and identify the type of the jump rope exercise by applying the classification model to the at least one first feature value and the at least one second feature value.

According to an embodiment, the at least one first feature value may include a variance of data on a dominant axis or data reproduced by synthesis on one or more axes among the acceleration data, and the at least one second feature value may include a variance of data on a dominant axis or data reproduced by synthesis on one or more axes among the gyro data.

According to an embodiment, the at least one first feature value may include a variance of the acceleration data, and the at least one second feature value may include a variance of the gyro data.

According to an embodiment, the at least one processor 120 may be configured to output a set of information corresponding to the identified type of the jump rope exercise.

According to an embodiment, the at least one processor 120 may be configured to store a correlation between the type of the jump rope exercise and the output set of information based on an input by a user of the wearable electronic device 101.

According to an embodiment, the at least one processor 120 may be configured to identify at least one of a required time of the jump rope exercise, a number of jump ropes of the jump rope exercise, a number of jump ropes per minute (cadence) of the jump rope exercise, a maximum impact amount of the jump rope exercise, a left/right balance of the jump rope exercise, and isokineticity of the jump rope exercise and output at least one of the required time of the jump rope exercise, the number of jump ropes of the jump rope exercise, the number of jump ropes per minute (cadence) of the jump rope exercise, the maximum impact amount of the jump rope exercise, the left/right balance of the jump rope exercise, and the isokineticity of the jump rope exercise.

According to an embodiment, the at least one processor 120 may be configured to perform, in response to the time of staying in the air exceeding a first threshold, at least one of outputting first guide information or outputting second guide information indicating the time of contacting the ground.

According to an embodiment, the at least my processor may be configured to identify a maximum impact amount of the jump rope exercise based on the acceleration data and output third guide information in response to the maximum impact amount of the jump rope exercise exceeding a second threshold.

According to an embodiment, the guide information may include a score corresponding to the jump rope exercise.

A method performed in a wearable electronic device 101 according to an embodiment may comprise obtaining acceleration data, identifying that a user of the wearable electronic device 101 is doing a jump rope exercise based on at least a portion of the acceleration data, identifying at least one of a time of staying in the air or a time of contacting a ground based on the acceleration data, and outputting guide information about the jump rope exercise based on at least one of the time of staying in the air or the touch time of contacting the ground.

According to, the method may further comprise obtaining gyro data and identifying that the user of the wearable electronic device is doing the jump rope exercise based on the gyro data and the acceleration data. "Based on" as used herein covers based at least on.

According to, the method may further comprise obtaining gyro data through the gyro sensor and identifying a type of the jump rope exercise based on a classification model identified through machine learning, the gyro data, and the acceleration data.

According to an embodiment, the type of the jump rope exercise may include at least one of jumping with both feet together, jump rope criss cross, double under, or alternate foot jump.

According to an embodiment, the method may further comprise outputting a set of information corresponding to the identified type of the jump rope exercise.

According to an embodiment, the method may further comprise identifying at least one of a required time of the jump rope exercise, a number of jump ropes of the jump rope exercise, a number of jump ropes per minute (cadence) of the jump rope exercise, a maximum impact amount of the jump rope exercise, a left/right balance of the jump rope exercise, and isokineticity of the jump rope exercise and outputting at least one of the required time of the jump rope exercise, the number of jump ropes of the jump rope exercise, the number of jump ropes per minute (cadence) of the jump rope exercise, the maximum impact amount of the jump rope exercise, the left/right balance of the jump rope exercise, and the isokineticity of the jump rope exercise.

According to an embodiment, outputting the guide information may include at least one of outputting first guide information or outputting second guide information indicating the time of contacting the ground in response to the time of staying in the air exceeding a first threshold.

It should be appreciated that various embodiments of the present disclosure and the terms used therein are not intended to limit the technological features set forth herein to particular embodiments and include various changes, equivalents, or replacements for a corresponding embodiment. With regard to the description of the drawings, similar reference numerals may be used to refer to similar or related elements. It is to be understood that a singular form of a noun corresponding to an item may include one or more of the things, unless the relevant context clearly indicates otherwise. As used herein, each of such phrases as "A or B," "at least one of A and B," "at least one of A or B," "A, B, or C," "at least one of A, B, and C," and "at least one of A, B, or C," may include all possible combinations of the items enumerated together in a corresponding one of the phrases. As used herein, such terms as "1st" and "2nd," or "first" and "second" may be used to simply distinguish a corresponding component from another, and does not limit the components in other aspect (e.g., importance or order). It is to be understood that if an element (e.g., a first element) is referred to, with or without the term "operatively" or "communicatively", as "coupled with," "coupled to," "connected with," or "connected to" another element (e.g., a second element), it means that the element may be coupled with the other element directly (e.g., wiredly), wirelessly, or via at least a third element(s).

As used herein, the term "module" may include a unit implemented in hardware, software, or firmware, and may interchangeably be used with other terms, for example, "logic," "logic block," "part," or "circuitry". A module may be a single integral component, or a minimum unit or part thereof, adapted to perform one or more functions. For example, according to an embodiment, the module may be implemented in a form of an application-specific integrated circuit (ASIC). Thus, each "module" herein may comprise circuitry.

Various embodiments as set forth herein may be implemented as software (e.g., the program 340) including one or more instructions that are stored in a storage medium (e.g., internal memory 336 or external memory 338) that is readable by a machine (e.g., the electronic device 301). For example, a processor (e.g., the processor 320) of the machine (e.g., the electronic device 301) may invoke at least one of the one or more instructions stored in the storage medium, and execute it, with or without using one or more other components under the control of the processor. This allows the machine to be operated to perform at least one function according to the at least one instruction invoked. The one or more instructions may include a code generated by a compiler or a code executable by an interpreter. The storage medium readable by the machine may be provided in the form of a non-transitory storage medium. Wherein, the term "non-transitory" simply means that the storage medium is a tangible device, and does not include a signal (e.g., an electromagnetic wave), but this term does not differentiate between where data is semi-permanently stored in the storage medium and where the data is temporarily stored in the storage medium.

According to an embodiment, a method according to various embodiments of the disclosure may be included and provided in a computer program product. The computer program products may be traded as commodities between sellers and buyers. The computer program product may be distributed in the form of a machine-readable storage medium (e.g., compact disc read only memory (CD-ROM)), or be distributed (e.g., downloaded or uploaded) online via an application store (e.g., Play Store™), or between two user devices (e.g., smartphones) directly. If distributed online, at least part of the computer program product may be temporarily generated or at least temporarily stored in the machine-readable storage medium, such as memory of the manufacturer's server, a server of the application store, or a relay server.

According to various embodiments, each component (e.g., a module or a program) of the above-described components may include a single entity or multiple entities. Some of the plurality of entities may be separately disposed in different components. According to various embodiments, one or more of the above-described components may be omitted, or one or more other components may be added. Alternatively or additionally, a plurality of components (e.g., modules or programs) may be integrated into a single component. In such a case, according to various embodiments, the integrated component may still perform one or more functions of each of the plurality of components in the same or similar manner as they are performed by a corresponding one of the plurality of components before the integration. According to various embodiments, operations performed by the module, the program, or another component may be carried out sequentially, in parallel, repeatedly, or heuristically, or one or more of the operations may be executed in a different order or omitted, or one or more other operations may be added.

While the disclosure has been illustrated and described with reference to various embodiments, it will be understood that the various embodiments are intended to be illustrative, not limiting. It will further be understood by those skilled in the art that various changes in form and detail may be made without departing from the true spirit and full scope of the disclosure, including the appended claims and their equivalents. It will also be understood that any of the embodiment(s) described herein may be used in conjunction with any other embodiment(s) described herein.

The invention claimed is:

1. A wearable electronic device, comprising:

an acceleration sensor;

at least one processor; and memory storing instructions, wherein the instructions, when executed by the at least one processor individually or collectively, cause the wearable electronic device to:

obtain acceleration data via the acceleration sensor;

identify that a user of the wearable electronic device is doing a jump rope exercise based on at least a portion of the acceleration data;

based on the at least a portion of the acceleration data during the jump rope exercise, identify at least one of a time of staying in the air or a time of contacting a ground based on the acceleration data; and output guide information about the jump rope exercise based on at least one of the time of staying in the air or the time of contacting the ground.

2. The wearable electronic device of claim 1, further comprising a gyro sensor, wherein the instructions, when executed by the at least one processor individually or collectively, cause the wearable electronic device to:

obtain gyro data via the gyro sensor; and identify that the user of the wearable electronic device is doing the jump rope exercise based on at least one of the time of staying in the air by the user based on a time from a lowest point of the at least a portion of the acceleration data to a next highest point of the at least a portion of the acceleration data or the time of contacting the ground by the user based on a time from a highest point of the at least a portion of the acceleration data to a next lowest point of the at least a portion of the acceleration data, using the gyro data and the acceleration data.

3. The wearable electronic device of claim 1, further comprising a gyro sensor, wherein the instructions, when executed by the at least one processor individually or collectively, cause the wearable electronic device to:

obtain gyro data via the gyro sensor; and identify a type of the jump rope exercise based on a classification model identified based on machine learning, the gyro data, and the acceleration data.

4. The wearable electronic device of claim 3, wherein the type of the jump rope exercise includes at least one of jumping with both feet together, jump rope criss cross, double under, or alternate foot jump.

5. The wearable electronic device of claim 3, wherein the instructions, when executed by the at least one processor individually or collectively, cause the wearable electronic device to:

identify a jump rope exercise session based on the acceleration data;

identify at least one first feature value based on the acceleration data within the jump rope exercise session;

identify at least one second feature value based on the gyro data within the jump rope exercise session; and identify the type of the jump rope exercise by applying the classification model to the at least one first feature value and the at least one second feature value.

6. The wearable electronic device of claim 5, wherein the at least one first feature value includes a variance of data on a dominant axis and/or data reproduced by synthesis on one or more axes among the acceleration data, and the at least one second feature value includes a variance of data on a dominant axis and/or data reproduced by synthesis on one or more axes among the gyro data.

7. The wearable electronic device of claim 5, wherein the at least one first feature value includes a variance of the acceleration data, and the at least one second feature value includes a variance of the gyro data.

8. The wearable electronic device of claim 3, wherein the instructions, when executed by the at least one processor individually or collectively. cause the wearable electronic device to output a set of information corresponding to the identified type of the jump rope exercise.

9. The wearable electronic device of claim 8, wherein the instructions, when executed by the at least one processor individually or collectively. cause the wearable electronic device to store a correlation between the type of the jump rope exercise and the output set of information based on an input by a user of the wearable electronic device.

10. The wearable electronic device of claim 1, wherein the instructions, when executed by the at least one processor individually or collectively, cause the wearable electronic device to:

based on the acceleration data, identify at least one of a required time of the jump rope exercise, a number of jump ropes of the jump rope exercise, a number of jump ropes per minute (cadence) of the jump rope exercise, a maximum impact amount of the jump rope exercise, a left/right balance of the jump rope exercise, or isokineticity of the jump rope exercise; and output at least one of the required time of the jump rope exercise, the number of jump ropes of the jump rope exercise, the number of jump ropes per minute (cadence) of the jump rope exercise, the maximum impact amount of the jump rope exercise, the left/right balance of the jump rope exercise, or the isokineticity of the jump rope exercise.

11. The wearable electronic device of claim 1, wherein the instructions, when executed by the at least one processor individually or collectively, cause the wearable electronic device to perform, in response to the time of staying in the air exceeding a first threshold, at least one of outputting first guide information or outputting second guide information indicating the time of contacting the ground.

12. The wearable electronic device of claim 1, wherein the instructions, when executed by the at least one processor individually or collectively, cause the wearable electronic device to:

identify a maximum impact amount of the jump rope exercise based on the acceleration data; and output third guide information in response to the maximum impact amount of the jump rope exercise exceeding a second threshold.

13. The wearable electronic device of claim 1, wherein the guide information includes a score corresponding to the jump rope exercise.

14. A method performed by a wearable electronic device, the method comprising:

obtaining acceleration data;

identifying that a user of the wearable electronic device is doing a jump rope exercise based on at least a portion of the acceleration data;

based on the at least a portion of the acceleration data during the jump rope exercise, identifying at least one of a time of staying in the air or a time of contacting a ground based on the acceleration data; and outputting guide information about the jump rope exercise based on at least one of the time of staying in the air or the time of contacting the ground.

15. The method of claim 14, further comprising:

obtaining gyro data; and identifying that the user of the wearable electronic device is doing the jump rope exercise based on the gyro data and the acceleration data.

16. The method of claim 14, further comprising:

obtaining gyro data; and identifying a type of the jump rope exercise based on a classification model identified based on machine learning, the gyro data, and the acceleration data.

17. The method of claim 16, wherein the type of the jump rope exercise includes at least one of jumping with both feet together, jump rope criss cross, double under, or alternate foot jump.

18. The method of claim 16, outputting a set of information corresponding to the identified type of the jump rope exercise.

19. The method of claim 14, further comprising:

based on the acceleration data, identifying at least one of a required time of the jump rope exercise, a number of jump ropes of the jump rope exercise, a number of jump ropes per minute (cadence) of the jump rope exercise, a maximum impact amount of the jump rope exercise, a left/right balance of the jump rope exercise, or isokineticity of the jump rope exercise; and outputting at least one of the required time of the jump rope exercise, the number of jump ropes of the jump rope exercise, the number of jump ropes per minute (cadence) of the jump rope exercise, the maximum impact amount of the jump rope exercise, the left/right balance of the jump rope exercise, or the isokineticity of the jump rope exercise.

20. The method of claim 14, further comprising:

wherein the outputting guide information includes, performing, in response to the time of staying in the air exceeding a first threshold, at least one of outputting first guide information or outputting second guide information indicating the time of contacting the ground.

* * * * *